US012575684B2

(12) United States Patent
Leng

(10) Patent No.: US 12,575,684 B2
(45) Date of Patent: Mar. 17, 2026

(54) ELASTIC CUSHION, ADDITIONAL ELASTIC CUSHION LAYER, AND FURNITURE

(71) Applicant: NEW-TEC INTEGRATION (XIAMEN) CO., LTD., Fujian (CN)

(72) Inventor: Luhao Leng, Xiamen (CN)

( * ) Notice: Subject to any disclaimer, the term of this patent is extended or adjusted under 35 U.S.C. 154(b) by 170 days.

(21) Appl. No.: 18/695,522

(22) PCT Filed: Sep. 15, 2022

(86) PCT No.: PCT/CN2022/119103
§ 371 (c)(1),
(2) Date: Mar. 26, 2024

(87) PCT Pub. No.: WO2023/051271
PCT Pub. Date: Apr. 6, 2023

(65) Prior Publication Data

US 2025/0009139 A1 Jan. 9, 2025

(30) Foreign Application Priority Data

Sep. 30, 2021 (CN) ..... 202111165817.0

(51) Int. Cl.
*A47C 27/05* (2006.01)
*A47C 27/00* (2006.01)
*A47C 27/15* (2006.01)

(52) U.S. Cl.
CPC ..... *A47C 27/056* (2013.01); *A47C 27/001* (2013.01); *A47C 27/15* (2013.01)

(58) Field of Classification Search
CPC ..... A47C 27/05; A47C 27/056; A47C 27/001; A47C 27/15; A47C 23/002; A47C 23/005; A47C 23/0438; A47C 23/057; A47C 27/06; A47C 27/063; A47C 27/065; A47C 27/07; A47C 27/148; A47C 27/20; A47C 27/22
See application file for complete search history.

(56) References Cited

U.S. PATENT DOCUMENTS 2,154,910 A * 4/1939 Magaril ..... A47C 27/05 5/722
4,423,308 A 12/1983 Callaway et al.
(Continued)

FOREIGN PATENT DOCUMENTS

CN 2455141 Y 10/2001
CN 2523299 Y 12/2002
(Continued)

OTHER PUBLICATIONS

Extended European Search Report for European Application No. 22874658.2; Date of Mailing: Aug. 6, 2025; 9 pages.
(Continued)

*Primary Examiner* — Fredrick C Conley
(74) *Attorney, Agent, or Firm* — Perkins Coie LLP

(57) ABSTRACT

An elastic pad includes a body and at least one additional separate elastic pad layer independent of the body. The at least one additional elastic pad layer can be stacked and attached on top of the body. The elastic pad is configured to allow users to select types, number and stacking sequence of additional elastic pad layers. The elastic pad provides users with convenience in assembling and replacing the additional elastic pad layers and a better customization experience without disassembling the body.

21 Claims, 33 Drawing Sheets

(56) References Cited

U.S. PATENT DOCUMENTS

| | | | | |
|---|---|---|---|---|
| 5,428,852 | A | 7/1995 | Tenuta et al. | |
| 6,128,798 | A * | 10/2000 | Barman | A47C 27/05 5/654.1 |
| 8,370,979 | B2 | 2/2013 | Fukano | |
| 12,064,036 | B2 * | 8/2024 | Sternving | A47C 27/06 |
| 2016/0316927 | A1 * | 11/2016 | Thomas | A47C 27/20 |
| 2020/0260881 | A1 | 8/2020 | Deragon | |

FOREIGN PATENT DOCUMENTS

| | | | |
|---|---|---|---|
| CN | 204245700 | U | 4/2015 |
| CN | 205083074 | U | 3/2016 |
| CN | 107874511 | A | 4/2018 |
| CN | 207202570 | U | 4/2018 |
| CN | 208582066 | U | 3/2019 |
| CN | 109717662 | A | 5/2019 |
| CN | 111657714 | A | 9/2020 |
| CN | 112674535 | A | 4/2021 |
| CN | 112674541 | A | 4/2021 |
| CN | 112674544 | A | 4/2021 |
| CN | 213128837 | U | 5/2021 |
| CN | 213757508 | U | 7/2021 |
| JP | 2003204844 | A | 7/2003 |
| JP | 2010184103 | A | 8/2010 |
| JP | 2010252937 | A | 11/2010 |
| JP | 2017196326 | A | 11/2017 |
| KR | 20090003442 | U | 1/2009 |
| WO | 0013550 | A2 | 3/2000 |
| WO | 2021073588 | A1 | 4/2021 |
| WO | 2021073589 | A1 | 4/2021 |
| WO | 2021073597 | A1 | 4/2021 |

OTHER PUBLICATIONS

Office Action in Japanese Application No. 2024-519639; Date of Mailing: Jul. 17, 2025; 5 pages.

* cited by examiner

C

D

ELASTIC CUSHION, ADDITIONAL ELASTIC CUSHION LAYER, AND FURNITURE

TECHNICAL FIELD

The present disclosure relates to the furniture field, and specifically to an elastic pad, an additional elastic pad layer and a furniture.

BACKGROUND

In the current household market there are high-end mattresses and low-end mattresses. Low-end mattresses are typically thin to facilitate transport and storage but cannot fully provide comfort. High-end mattresses, although comfortable, are thick and generally have complicated inner structures, Due to their complicated internal structures, the high-end mattresses cannot be disassembled. As they are typically one-piece mattresses, high-end mattresses are inconvenient to transport and store. In addition, as some components of the high-end mattresses wear out, the whole mattress must be discarded, resulting in waste.

All of the existing high-end mattresses have one-piece structures, making it impossible for users to adjust the hardness. If expecting to have different experiences, users have to purchase a lot of high-end mattresses. There still lack high-end mattresses that can be customized by users in the current market.

Even assuming that there is the solution allowing disassembling and customization of high-end mattresses, how to accelerate the customization and facilitate operations is still a topic worthy of further study.

As a result, there arises a need for an elastic pad, an additional pad layer and a furniture, to at least partly solve the above-mentioned problem.

SUMMARY

The main objective of the present disclosure is to provide an elastic pad, an elastic pad layer and a furniture. The elastic pad according to the present disclosure is a high-end elastic pad exhibiting good performance in comfort. As compared with the existing elastic pad of the same type, the elastic pad according to the present disclosure can be customized by users. As compared with the technical solution where the additional elastic pad layers are arranged within the outer cover, such arrangement can facilitate users in assembling and replacing the additional elastic pad layers.

According to a first aspect of the present disclosure, there is provided an elastic pad for users to sit and lie, which can be customized by the users, characterized in that the elastic pad comprises:

an elastic pad body comprising:

an outer cover configured to define a closed receiving space;

an elastic module layer disposed within the receiving space, the elastic module layer comprising a plurality of elastic modules arranged in an array, each of the elastic modules provided therein with a conical spring in a compressed state along a height direction of the elastic pad; and an elastic balance mesh layer on which a plurality of openings are opened, dimensions of the openings being consistent with outer diameters of the elastic modules at a predetermined height so that the elastic balance mesh layer can respectively sleeve the plurality of the elastic modules within corresponding ones of the openings, to link all the elastic modules;

at least one additional elastic pad layer separate from one another and all independent of the elastic pad body, the at least one additional elastic pad layer configured to be stacked and attached outside of a top of the elastic pad body, wherein the elastic pad is configured to allow the users to select types, a number and a stacking sequence of the additional elastic pad layers.

In an implementation, the at least one additional elastic pad layer is configured to allow the users to select a first additional elastic pad layer, a second additional elastic pad layer and a third additional elastic layer differing in hardness, wherein a hardness of the third additional elastic pad layer is greater than a hardness of the second additional elastic pad layer, and the hardness of the second additional elastic pad layer is greater than a hardness of the first additional elastic pad layer.

In an implementation, the at least one additional elastic pad layer is configured to allow the users to stack the additional elastic pad layers in the following manner:

the first additional elastic pad layer is closest to the users, and the third additional elastic pad layer is the farthest from the users; or the second additional elastic pad layer is the closest to the users, and the third additional elastic pad layer is the farthest away from the users; or the third additional elastic pad layer is the closest to the users, and the first additional pad layer is the farthest away from the users; or the first additional elastic pad layer is the closest to the users, and the second additional pad layer is the farthest away from the users; or the second additional elastic pad layer is the closest to the users, and the first additional pad layer is the farthest away from the users; or the third additional elastic pad layer is the closest to the users, and the second additional pad layer is the farthest away from the users.

In an implementation, the elastic pad is configured to allow the users to select the additional elastic pad layers from the following additional elastic pad layer group: an additional elastic pad layer formed of duck down; an additional elastic pad layer formed of goose down; an additional elastic pad layer formed of memory foam; an additional elastic pad layer formed of ordinary sponge; an additional elastic pad layer formed of latex; and an additional elastic pad layer formed of coir.

In an implementation, each of the at least one additional elastic pad layer on a side is fixedly provided with a first engagement structure, and the elastic pad body is fixedly provided thereon with a corresponding second engagement structure configured to engage the first engagement structure of an additional elastic pad layer stacked on a top side of the elastic pad body.

In an implementation, when at least two additional elastic pad layers in the at least one additional elastic pad layer are stacked on the top side of the elastic pad body, the first engagement structures of the at least two additional elastic pad layers are aligned in the height direction of the elastic pad, and the elastic pad body is provided thereon with only one of the second engagement structure configured to engage all of the first engagement structures of the at least two additional elastic pad layers.

In an implementation, the first engagement structure is a buckle, and the second engagement structure comprises a webbing and an upper fastener and a lower fastener located on two ends of the webbing, wherein the first engagement structure and the second engagement structure are configured so that the webbing can pass through the buckle of each of the at least two additional elastic pad layers and fastened by the upper fastener and the lower fastener.

In an implementation, the first engagement structure and the second structure are sliding fasteners or Magic® hook and loop tape.

In an implementation, each of the elastic modules comprises a spring bracket for receiving and holding the conical spring, the elastic module layer further comprises an elastic module layer bottom layer and a plurality of rail beams disposed on the elastic module layer bottom layer, and the plurality of elastic modules are configured to be mounted on the plurality of rail beams and slide in place along corresponding rail beams.

In an implementation, each of the rail beams is configured to engage slidable modules on left and right sides thereof so that the elastic modules on the left and sides of the rail beam can slide independently of each other along corresponding rails.

In an implementation, each of the rail beams comprises:

a support wall extending from a top side of the rail beam to a bottom side thereof along a vertical direction;

a top side engagement portion, the top side engagement portion at a middle part being connected to a top side of the support wall, extending respectively towards left and right sides of the support wall and bending downwards, to thus form two top side receiving portions opened downwards on a top of the rail beam; and a bottom side engagement portion, the bottom side engagement portion at a middle part being connected to a bottom side of the support wall, extending respectively towards the left and right sides of the support wall and bending upwards, to thus form two bottom side receiving portions opened upwards on a bottom of the rail beam, wherein the spring bracket of each of the elastic modules at left and right sides is provided with mating protrusions engagable with the top side receiving portions and the bottom side receiving portions of the rail beam, the mating protrusions respectively protruding upwards from top surfaces on two sides of a bottom of the spring bracket and protruding downwards from bottom surfaces on two sides of the bottom of the spring bracket.

In an implementation, each of the rail beams comprises:

a base portion disposed on the bottom cover body;

a pair of connection walls extending upwards from left and rights of the base portion; and a pair of end walls extending towards each other from the pair of connection walls, a gap existing between the pair of end walls, wherein the base portion, respectively with the pair of connection walls and the pair of end walls, defines a pair of receiving portions opened towards each other, wherein the spring bracket of each of the elastic modules at left and right sides is provided with connection legs extending downwards, and mating protrusions extending away from each other are disposed on bottom ends of the connection legs and configured to engage a pair of the receiving portions of each of the rail beams.

In an implementation, a partition wall is disposed in a middle of the two connection walls of the base portion, and a height of the partition wall is less than a height of the connection walls.

In an implementation, the connection walls on the left and right sides of the base portion are arranged at an interval in an extending direction of the rail beam and are staggered from each other.

In an implementation, a plurality of groups of rail beam mounting parts are disposed removably on the bottom cover body, and each group of the rail beam mounting parts are arranged at intervals along an extending direction of the rail beam corresponding thereto.

In an implementation, each of the rail beam mounting parts is fixed to a top surface of the bottom cover body by ultrasonically welding, riveting or bonding.

In an implementation, each of the rail beam mounting parts comprises a mounting part protrusion located on top thereof, the mounting part protrusion protrudes along a direction perpendicular to the extending direction of the rail beam and parallel to the bottom cover body, a mounting receiving portion corresponding to the mounting part protrusion is disposed on a bottom of the rail beam, and the mounting part protrusion is configured to mate with the mounting receiving portion of the rail beam so that the rail beam can slide along the extending direction thereof relative to the rail beam mounting part and be mounted in place.

In an implementation, the rail beam can be directly fixed onto an inner surface of the outer cover by ultrasonically welding, riveting or bonding.

In an implementation, each of the rail beams comprises a plurality of rail beam segments connected sequentially.

In an implementation, each of the rail beam segments is provided at a front end with a protrusion protruding forwards and provided at a rear end with a recess recessed inside the rail beam segment, and a protrusion and a recess of the rail beam segments adjacent to each other fit into each other to connect the rail beam segments adjacent to each other.

In an implementation, the elastic pad body comprises two layers of the elastic module layers.

In an implementation, an outer contour of each of the elastic modules is of a truncated cone shape, the two layers of the elastic module layers comprise a first elastic module layer and a second elastic module layer on a top side of the first elastic module layer, and the first elastic module layer and the second elastic module layer are stacked so that: small-diameter axial ends of elastic modules of the first elastic module layer face small-diameter axial ends of elastic modules of the second elastic module layer; or small-diameter axial ends of elastic modules of the first elastic module layer face large-diameter axial ends of elastic modules of the second elastic module layer.

In an implementation, the elastic pad comprises two layers of the balance mesh layers, and the two layers of the balance mesh layers and the two layers of the elastic module layers correspond one by one.

In an implementation, a dimension of each of the openings is consistent with an outer diameter of each of the small-diameter axial ends of the elastic modules.

In an implementation, the outer cover comprises a top cover body, a bottom cover body and a side girdle between the bottom cover body and the top cover body and extending entirely along a circumferential direction, and the side girdle and the top cover body, and the side girdle and the bottom cover body are connected removably, respectively, to allow the users to select and replace the elastic module layer and the elastic balance mesh layer as desired.

According to a second aspect of the present disclosure, there is provided an additional elastic pad layer, where the additional elastic pad layer is the additional elastic pad layer in the elastic pad of any one of the above-mentioned solutions.

According to a third aspect of the present disclosure, there is provided a furniture, where the furniture comprises the elastic pad of any one of the above-mentioned solutions.

In an implementation, the furniture is a bed, a sofa or a sofa bed.

BRIEF DESCRIPTION OF THE DRAWINGS

For the sake of better understanding on the above and other objectives, features, advantages, and functions of the present disclosure, the preferred embodiments are provided with reference to the drawings. The same reference symbols refer to the same components throughout the drawings. It is to be understood by those skilled in the art that the drawings are merely provided to illustrate preferred embodiments of the present disclosure, without suggesting any limitation to the protection scope of the present application, and respective components therein are not necessarily drawn to scale.

DETAILED DESCRIPTION OF EMBODIMENTS

Reference now will be made to the drawings to describe in detail implementations of the present disclosure. What will be described herein will only cover preferred implementations of the present disclosure, and those skilled in the art would envision other possible manners which also fall into the scope described herein, on the basis of the preferred implementations described herein.

According to the present disclosure, there are provided an elastic module for a household product and a furniture including the same. The elastic pad may be, for example, a mattress, a sofa cushion or other pad for a user to sit or lie thereon. The elastic pad can be customized and assembled, disassembled or stored by a user. FIGS. 1-27 illustrate some preferred implementations according to the present disclosure.

It is worth noting that directional and positional terms as mentioned here are to be read with reference to the implementations as shown in FIGS. 1-27. The directional and positional terms used here all indicate relative directions and positions among respective components, rather than absolute directions and positions.

Figure 1:
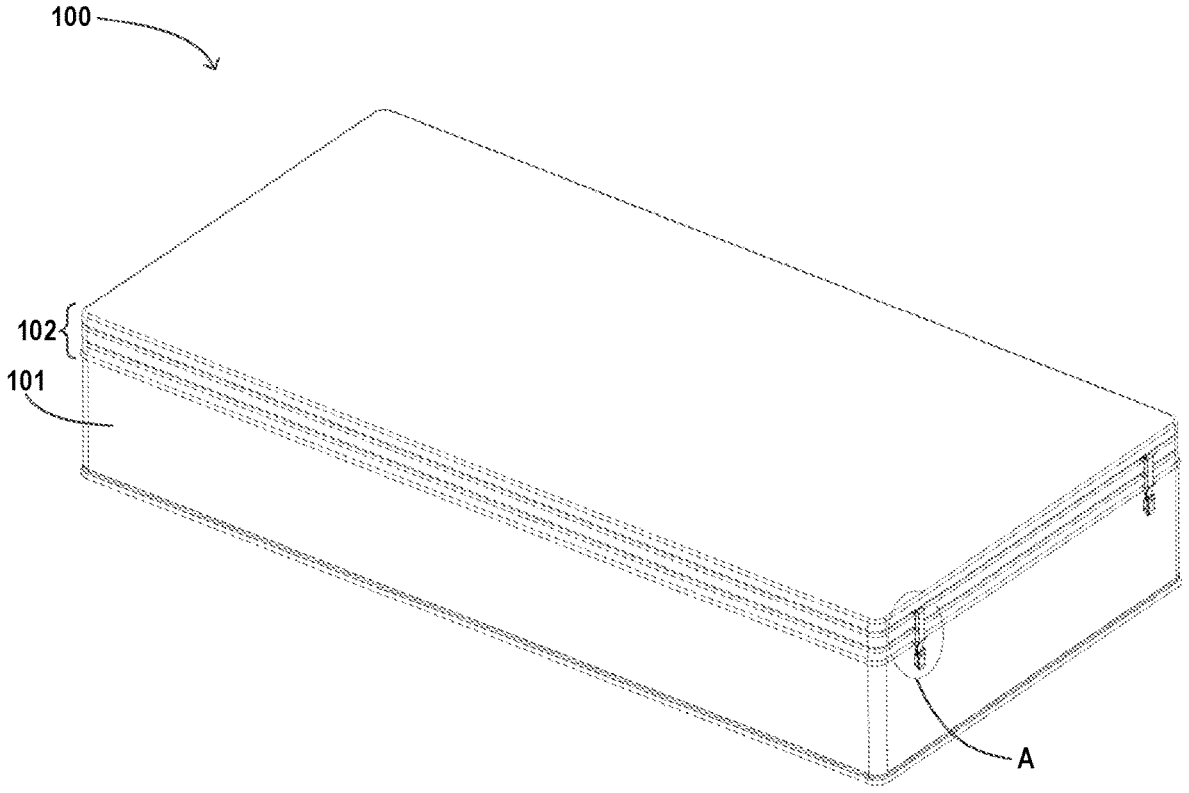
FIG. 1 is a three-dimensional view of an elastic pad in an assembled stated according to an implementation of the present discourse.
Figure 2:
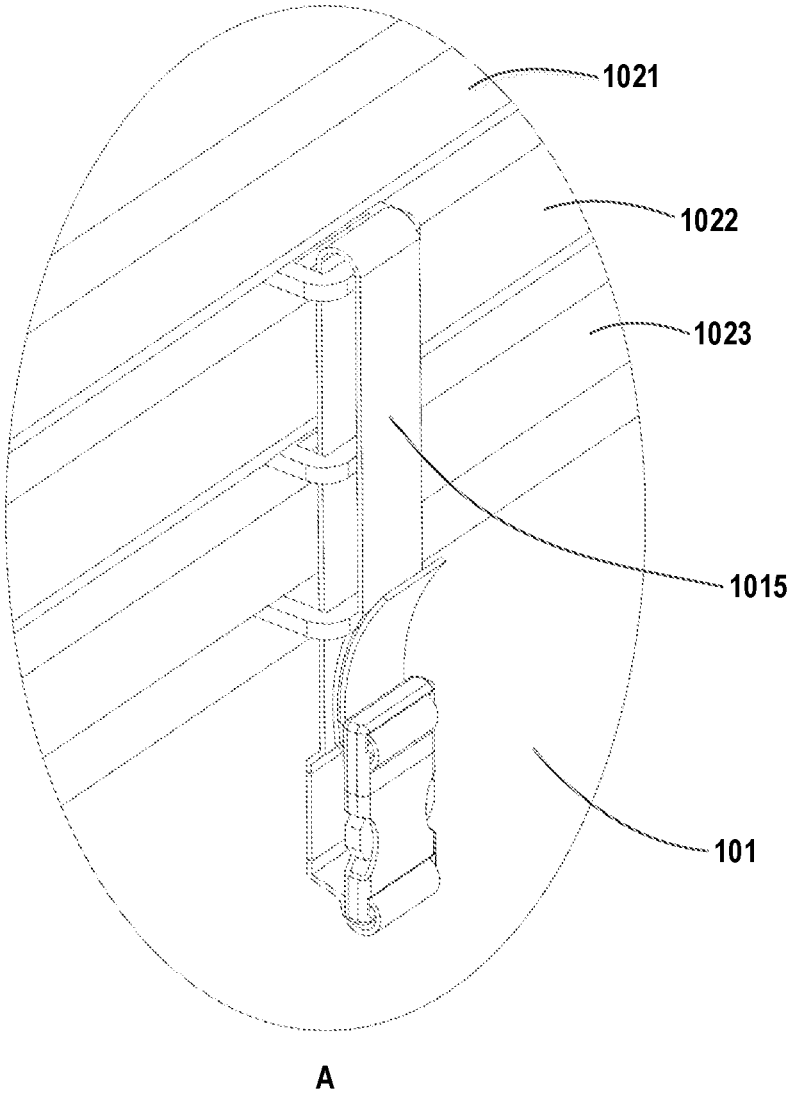
FIG. 2 is a partially enlarged view of the part A in FIG. 1.
Figure 3:
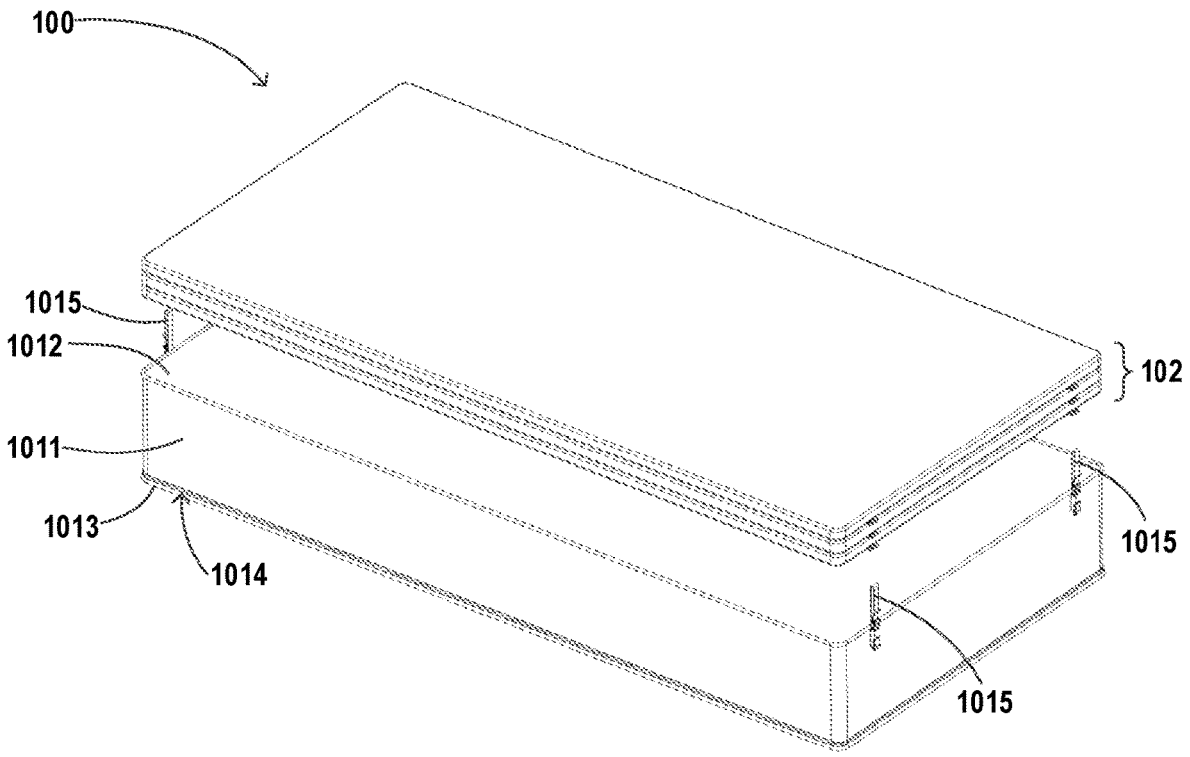
FIG. 3 is a schematic diagram of the elastic pad body and the additional elastic pad layer in FIG. 1 which are separated from each other.

Referring now to FIG. 1, the elastic pad in a preferred implementation according to the present disclosure is a cuboid structure, and the "longitudinal direction," "transverse direction" and "height direction" below are to be read with reference to the cuboid structure as shown in FIG. 1. For example, respective rail beams in the preferred implementations of the present disclosure extend along the transverse direction and are arranged at intervals along the longitudinal direction. "Left and right sides" of a certain component are to be read as two sides of the component in the transverse direction. In addition, "a circumferential direction" as used here is not necessarily applied to a circular structure. In the structure as shown in FIG. 1, the direction around the elastic pad 100 on the plane defined by the transverse direction and the longitudinal direction is the circumferential direction.

Referring to FIG. 1, the elastic pad 100 includes an elastic pad body 101 and at least one additional elastic pad layer 102. Wherein, the at least one additional elastic pad layer 102 is separate from one other and independent of the elastic pad body 101, and the at least one additional elastic pad layer 102 can be stacked and attached outside of the top of the entirety of the elastic pad body 101. FIG. 1 exemplarily illustrates three additional elastic pad layers 102. However, the present disclosure is not limited to the example, and users may select desired types and/or a desired number of the additional elastic pad layers 102 according to needs. Hereinafter will be given example supports of the description about "the users' demands" and the like.

FIGS. 2-6 illustrate an attachment method between the additional elastic pad layers 102 and the elastic pad body 101 according to this implementation. In general, each of the additional elastic pad layers 102 on a side is fixedly provided with a first engagement structure, and the elastic pad body 101 is correspondingly fixedly provided with a second engagement structure configured to engage the first engagement structure of the additional elastic layer stacked on the top layer of the elastic pad body 101.

Figure 4:
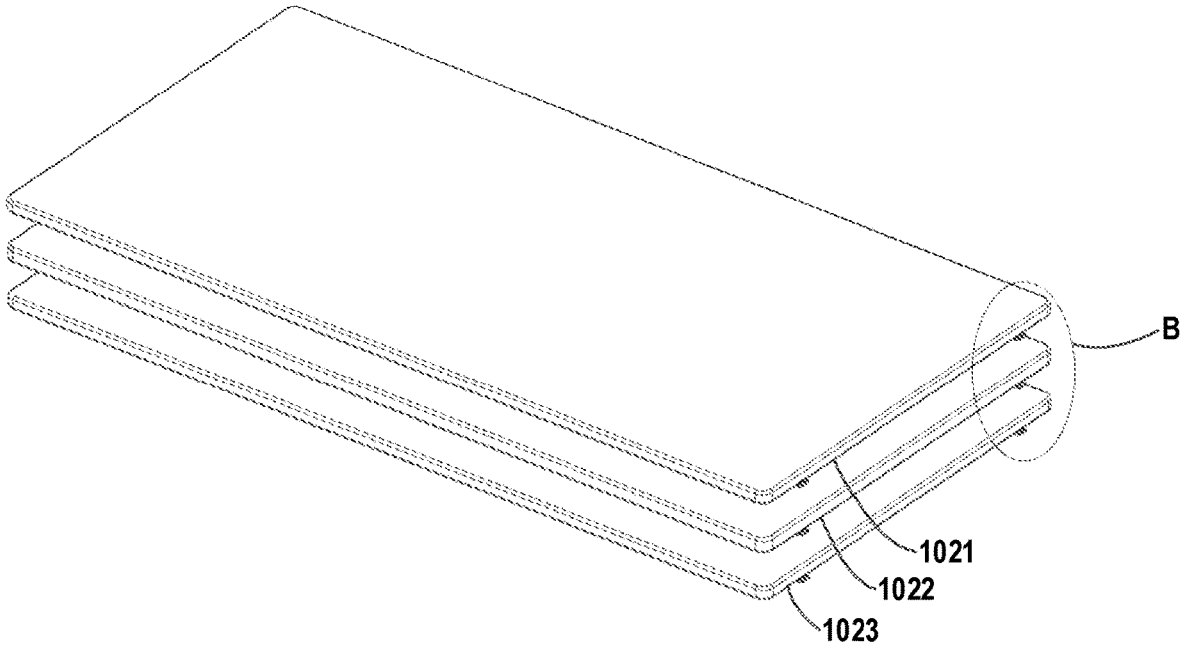
FIG. 4 is a view of the plurality of additional elastic pad layers in FIG. 3 which are separated from one another.
Figure 5:
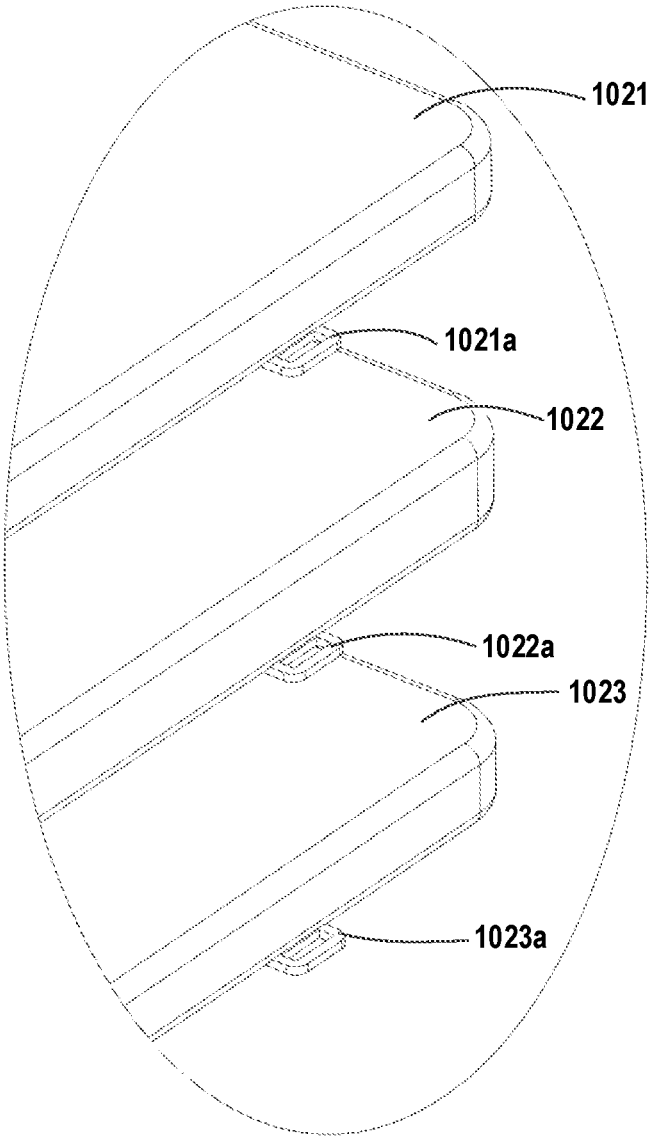
FIG. 5 is a partially enlarged view of the part B in FIG. 4.
Figure 6:
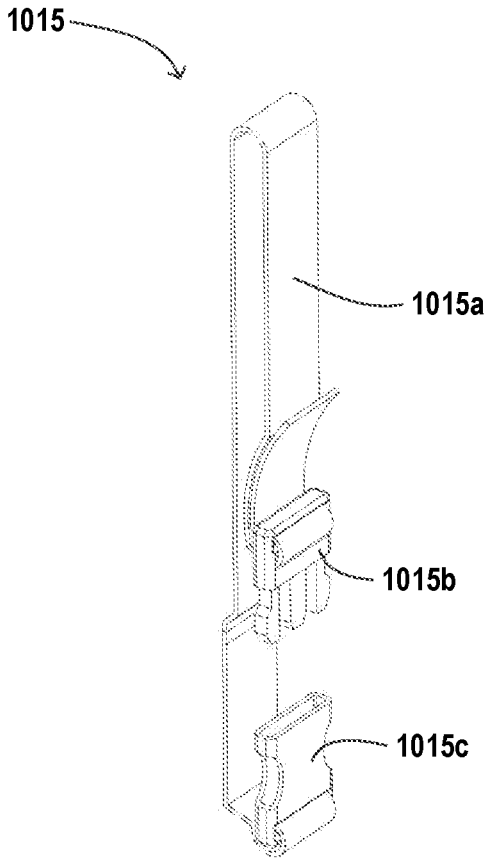
FIG. 6 is an enlarged view of the second engagement structure in FIG. 2.

In this implementation, referring to FIGS. 4 and 5, the first additional elastic pad layer 1021 on a side is provided with a buckle 1021*a* as the first engagement structure, the second additional elastic pad layer 1022 on a side is provided with a buckle 1022*a* as the first engagement structure, and the third additional elastic pad layer 1023 on a side is provided with a buckle 1023*a* as the first engagement structure. Wherein, the respective buckles of the first additional elastic pad layer 1021, a second additional elastic pad layer 1022 and a third additional elastic pad layer 1023 are aligned in the height direction of the elastic pad. Meanwhile, the elastic pad body 101 is provided with only one second engagement structure 1015 configured to engage with all the engagement structures of the additional elastic pad layers 102. The second engagement structure 1015 includes a webbing 1015*a* and an upper fastener 1015*b* and a lower fastener 1015*c* at two ends of the webbing 1015*a*, the first engagement structure and the second engagement structure are configured to enable the webbing to pass through the buckles of all of the additional elastic pad layers 105 and be fastened via the upper fastener 1015*b* and the lower fastener 1015*c*.

In other implementations not shown, the first engagement structures and the second engagement structure are slide fasteners, magic tapes or snap buttons. For example, the first engagement structures may be a plurality of structures aligned in the height direction, such as magnets, snap buttons, magic tapes and the like, and the second engagement structure may be one structure configured to simultaneously engage all of the first engagement structure.

Figure 10A:
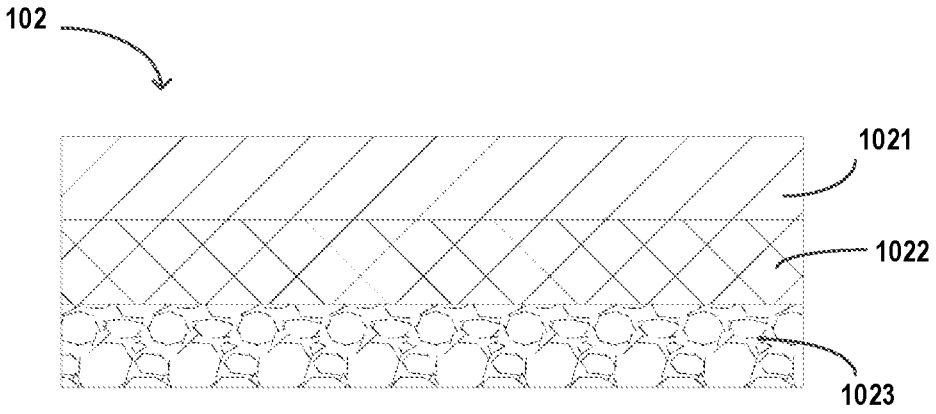
FIGS. 10A-10C are schematic diagrams of a combination of several types of additional elastic pad layers.
Figure 10B:
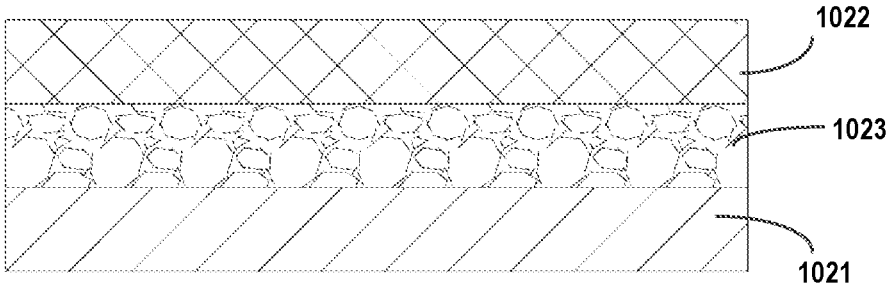
Figure 10C:
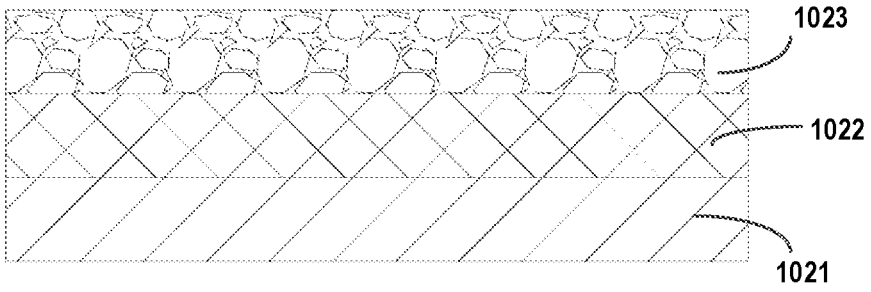
Figure 11:
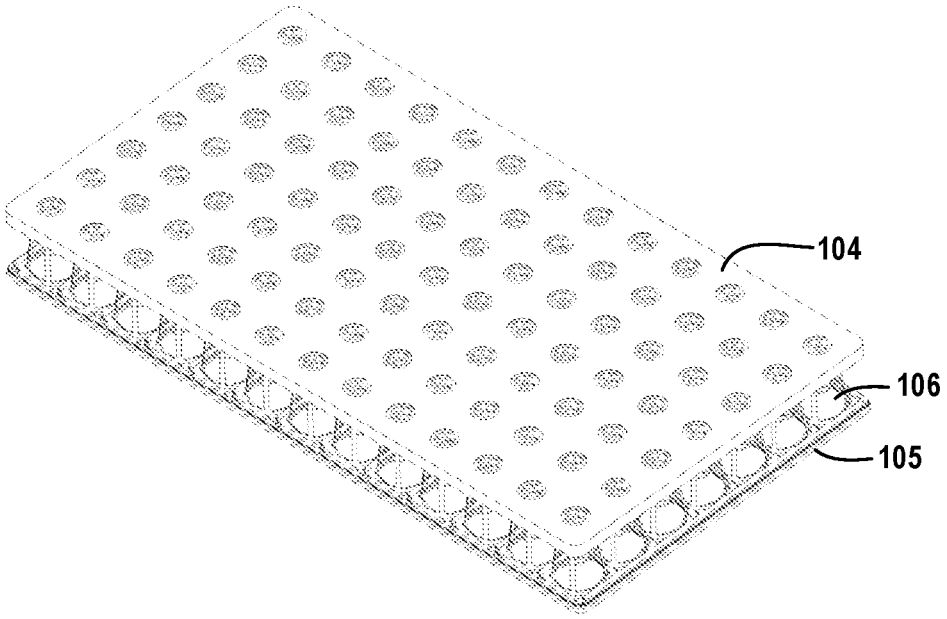
FIG. 11 is a schematic diagram of a combination of an elastic module layer and a balance mesh layer in any one type of the elastic pad bodies shown in FIGS. 7A-9B.

Reference will be made to FIGS. 10A-10C to describe several types of example additional elastic pad layers. In FIGS. 10A-10C, the additional elastic pad layer includes a first additional elastic pad 1021, a second additional elastic pad 1022 and a third additional elastic pad 1023 independent of one another. The hardness of the third additional elastic pad layer 1023 is greater than that the second additional elastic pad layer 1022, and the hardness of the second additional elastic pad layer 1022 is greater than that of the first additional elastic pad layer 1021.

In the combination of additional elastic pad layers as shown in FIG. 10A, the first additional elastic pad layer 1021 is the closest to users, the third additional elastic pad layer 1023 is the farthest away from the users, and the second additional elastic pad layer 1022 is sandwiched between the first additional elastic pad layer 1021 and the second additional elastic pad layer 1022.

In the combination of additional elastic pad layers as shown in FIG. 10B, the second additional elastic pad layer 1022 is the closest to users, the first additional elastic pad layer 1021 is the farthest away from the users, and the third additional elastic pad layer 1023 is sandwiched between the first additional elastic pad layer 1021 and the second additional elastic layer 1022. In FIG. 10B, the positions of the first additional elastic pad layer 1021 and the second additional elastic pad layer 1022 can be swapped.

In the combination of additional elastic pad layers as shown in FIG. 10C, the third additional elastic pad layer 1023 is the closest to users, the first additional elastic pad layer 1021 is the farthest away from the users, and the second additional elastic pad layer 1022 is sandwiched between the first additional elastic pad layer 1021 and the second additional elastic pad layer 1022.

Alternatively, in other implementations, the first additional elastic pad layer is located in the middle, and the second or third additional elastic pad layer is located on the top or bottom of the first additional elastic pad layer, respectively. In the implementations as shown in FIGS. 10A-10C and other combinations of additional elastic pads, respective required additional elastic pad layers may be selected from the following additional elastic pad layers: an additional elastic pad layer formed of duck down; an additional elastic pad layer formed of goose down; an additional elastic pad layer formed of memory foam; an additional elastic pad layer formed of ordinary sponge; an additional elastic pad layer formed of latex; and an additional elastic pad layer formed of coir. In addition, users may select, as demanded, the types, the number and the stacking arrangement of the combination of the desired additional elastic pad layers. The users' demands may include softness or hardness demands (e.g. some users prefer the additional elastic pads formed of harder coir closer to the users), tactile demands (e.g. users usually choose materials that are more skin-friendly, such as an additional elastic pad formed of cashmere, to be placed on the side close to the users, and an additional elastic pad formed of latex with better elasticity to be placed on the side closer to the users), hearing demands (it would be appreciated that some materials may generate weak noises when squeezed, and users tend to place these materials on the side away from them), olfactory demands (some users like the natural smell of cashmere, goose down or the like, and prefer placing such material on the side close to the user), demands to keep away from allergens (users choose to place an additional elastic pad formed of a material that may cause allergies on a side away from them) and the like. That is, the present disclosure provides sufficient support to the "users' demands."

In the implementation, there are also provided multiple preferred arrangements about the elastic pad body. Referring to FIGS. 1, 3, 7A and 7B, the elastic pad body includes an outer cover 1011, an elastic module layer and an elastic balance mesh layer 104. The outer cover 1011 is configured to define a closed receiving space, and includes a top cover body 1012, a bottom cover body 1013 and a side girdle 1011, where a slide fastener 1014 is arranged between the side girdle 1011 and the bottom cover body 1013. The elastic module layer is arranged within the receiving space and includes a plurality of elastic modules 106 arranged in an array, where each elastic module 106 is provided therein with a conical spring in a compressed state along the height direction of the elastic pad. Continuing to refer to FIG. 1, a plurality of openings are opened on the elastic balance mesh layer 104, and the dimension of each openings is consistent with the outer diameter of the elastic module 106 at a predetermined height so that the elastic balance mesh layer

104 can sleeve the plurality of elastic modules 106 within the openings, respectively, and thus associate all the elastic modules 106.

It is worth noting that "the additional elastic pad layers can be stacked and attached outside of the top of the entirety of the elastic pad body" as mentioned here indicates that the additional elastic pad layers 102 should be arranged above the top cover 1012. As compared with the technical solution that the additional elastic pad layers are arranged within the outer cover, such arrangement can facilitate assembling and replacing of the additional elastic pad layers for users. According to the present disclosure, users need not disassemble the elastic pad body frequently, and the cover body of the elastic pad body may be formed of a wear-resistant, dirt-resistant material.

Further, the elastic pad is configured to allow users to select the desired types and/or the desired number of elastic module layers, further select a side girdle adapted to the elastic pad layers in height and total thickness, and assemble the top cover body, the bottom cover body, the selected side girdle and the selected additional elastic pad layers to obtain the elastic pad.

Figure 27:
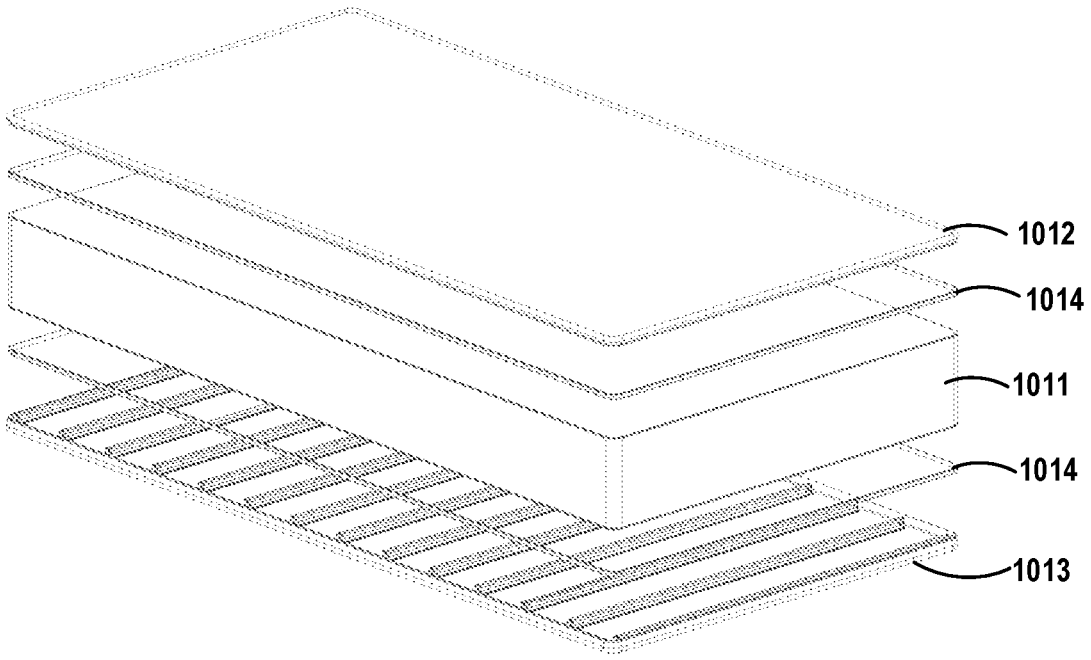
FIG. 27 is an exploded view of an elastic pad body, where elastic modules are removed.

Since the elastic pad according to the present disclosure enables users to select the types and the number of the elastic module layers, the total stacking height of the elastic module layers is not fixed. In the case, a cover 1011 including a plurality of side girdles differing in height is provided to fit with the elastic pad for, the users' selection. On the basis, preferably referring to another implementation as shown in FIG. 27, a slide fastener is arranged respectively between the top cover body 1012 and the side girdle 1011, and between the bottom cover body 1013 and the side girdle 1011.

It would be appreciated that a slide fastener arranged between the top cover body and the side girdle is not a conventional arrangement in the art. For a conventional outer cover of a mattress, even if the slide fastener is provided, there is only one slide fastener. On one hand, the production procedure can be saved, and on the other hand, this prevents the outer cover from being partitioned into multiple components and thus avoids loss. Accordingly, for a conventional elastic pad, such as a mattress and the like, it is a preferred arrangement that no slide fastener or only one slide fastener is provided, and the technical solution of providing two slide fasteners to partition the outer cover into three parts is obviously inferior. In the circumstance, those skilled in the art would not be inspired to modify the conventional mattress cover as the one where a slider fastener is respectively arranged between the top cover body and the side girdle, and the bottom cover body and the side girdle.

Figure 7A:
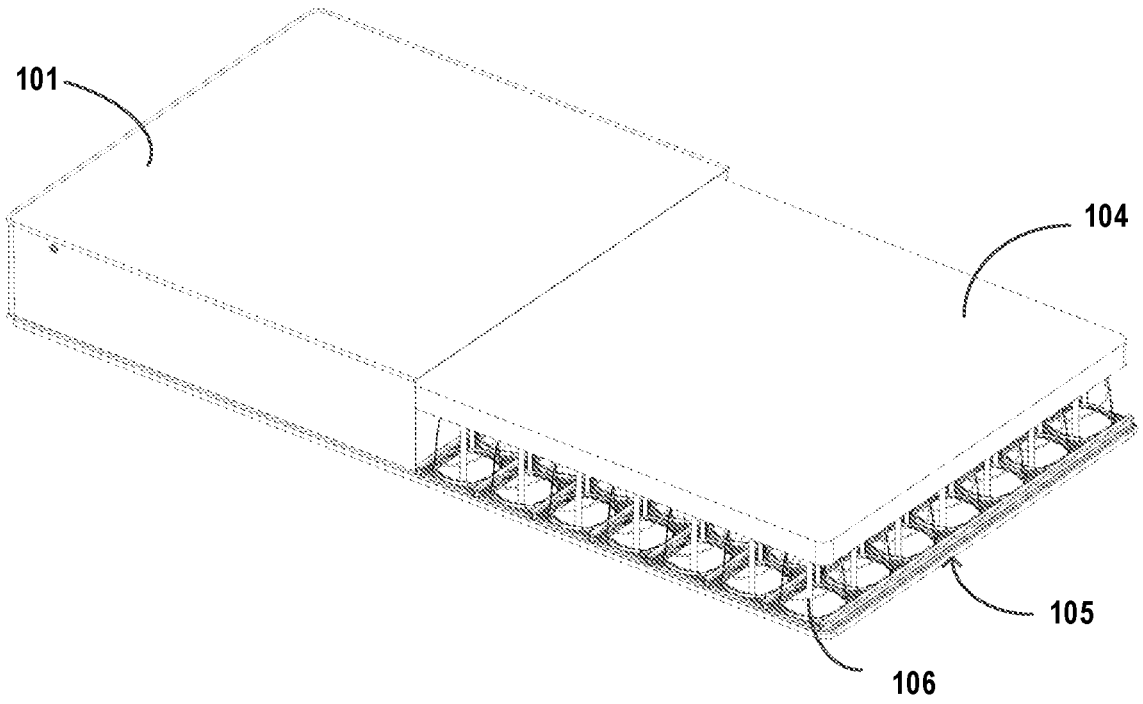
FIGS. 7A-7B are schematic diagrams of an elastic pad body according to an implementation.
Figure 7B:
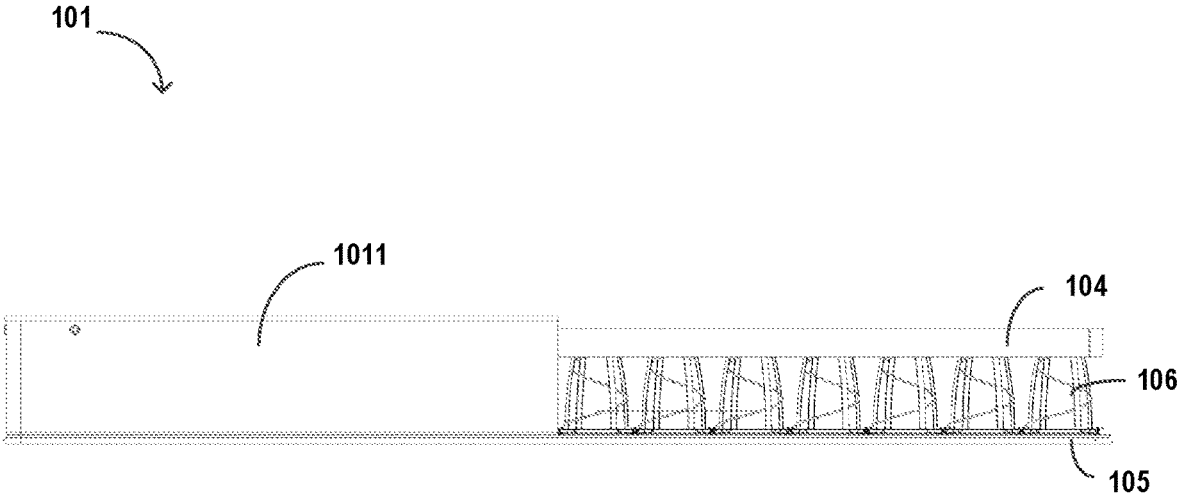
Figure 12:
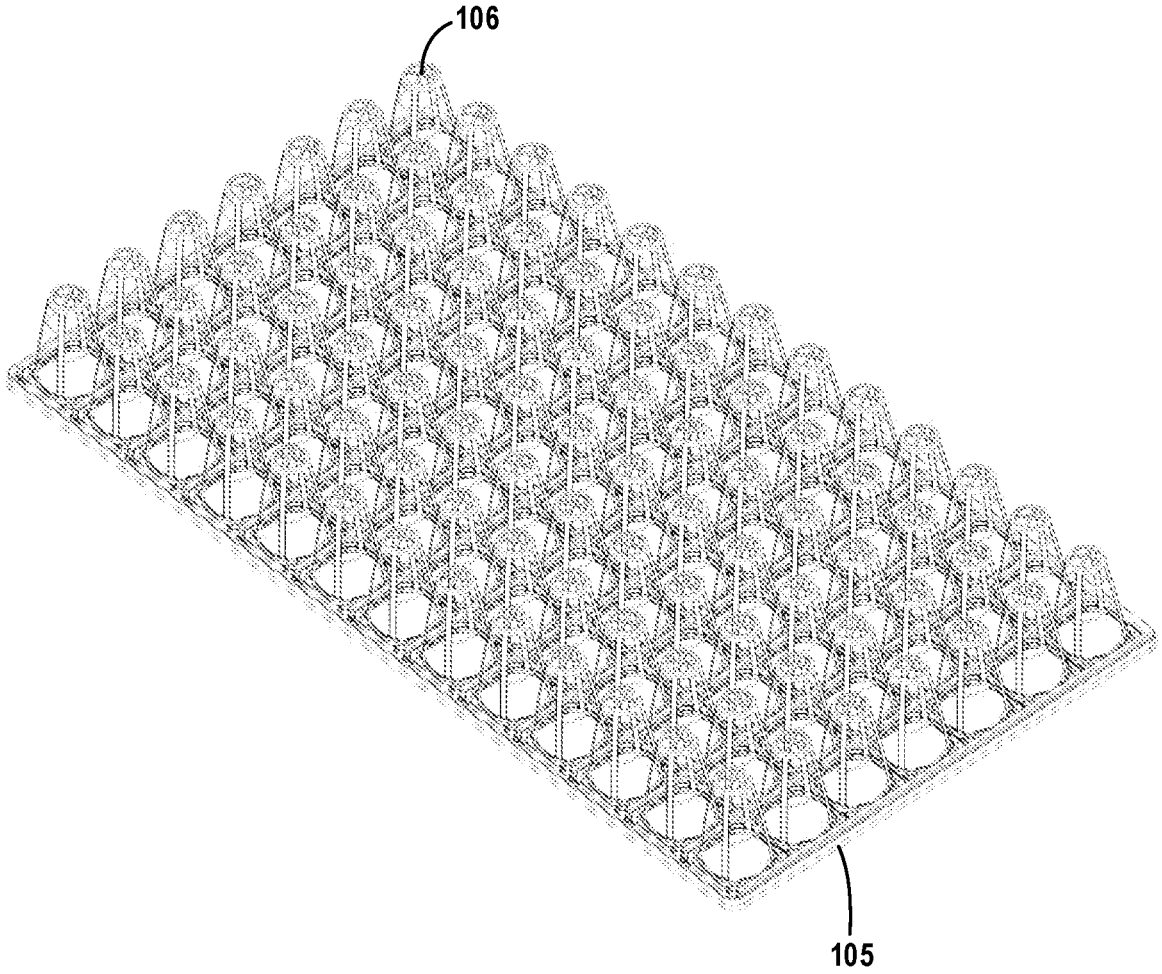
FIG. 12 is a schematic diagram of a bottom cover body having elastic modules mounted thereon in the elastic pad body in FIG. 1.

FIG. 12 illustrates an example of the elastic module layer in FIGS. 7A-7B. In the elastic pad body 101, a plurality of elastic modules 106 are arranged on an elastic module bottom layer 105 in an array along a plane perpendicular to the height direction to form an elastic module layer. In addition, springs within each elastic module is in a compressed state in the height direction. It is worth noting that, in the implementation, the elastic module layer bottom layer 105 is integrated on the bottom cover body 1013. However, in other implementations, the elastic module layer may be arranged independently of the outer cover 110, and the elastic module layers can be entirely arranged within the outer cover 110 or removed from the outer cover 110.

FIGS. 8A-9B illustrate alternative implementations as shown in FIGS. 7A-7B.

Figure 8A:
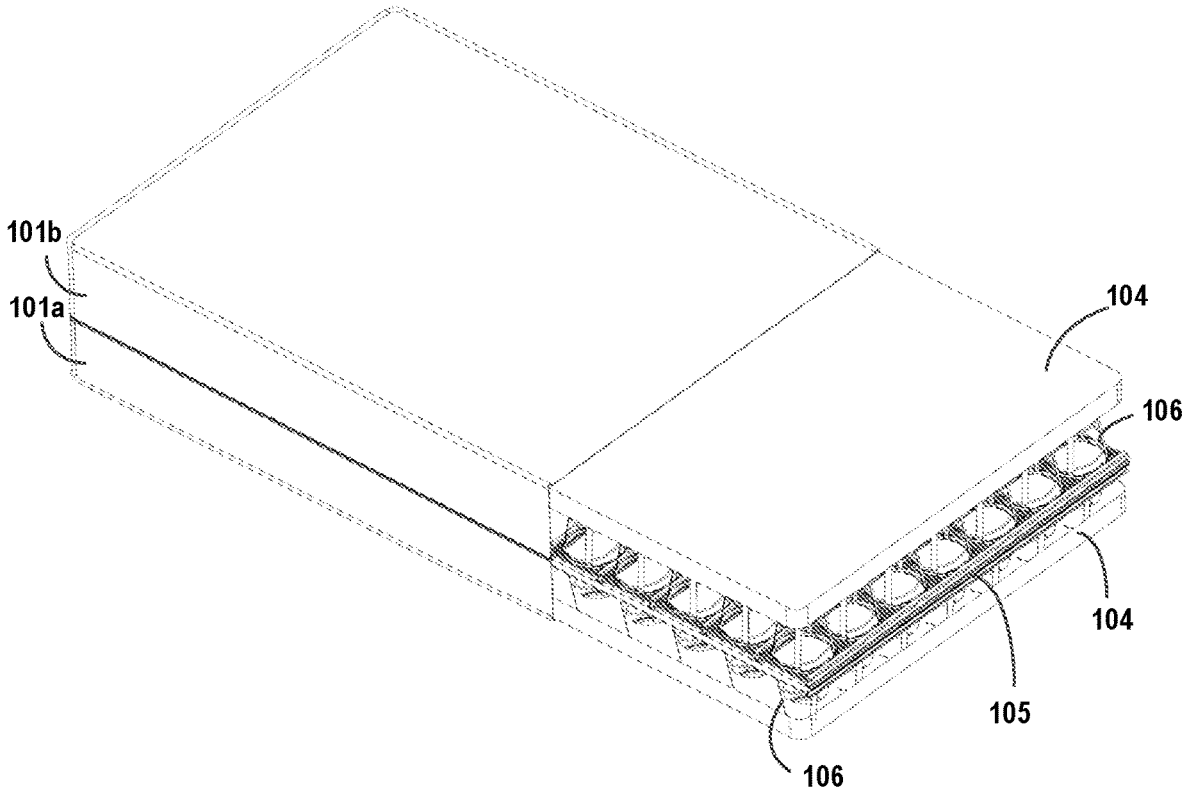
FIGS. 8A-8B are schematic diagrams of an elastic pad body according to an implementation.
Figure 8B:
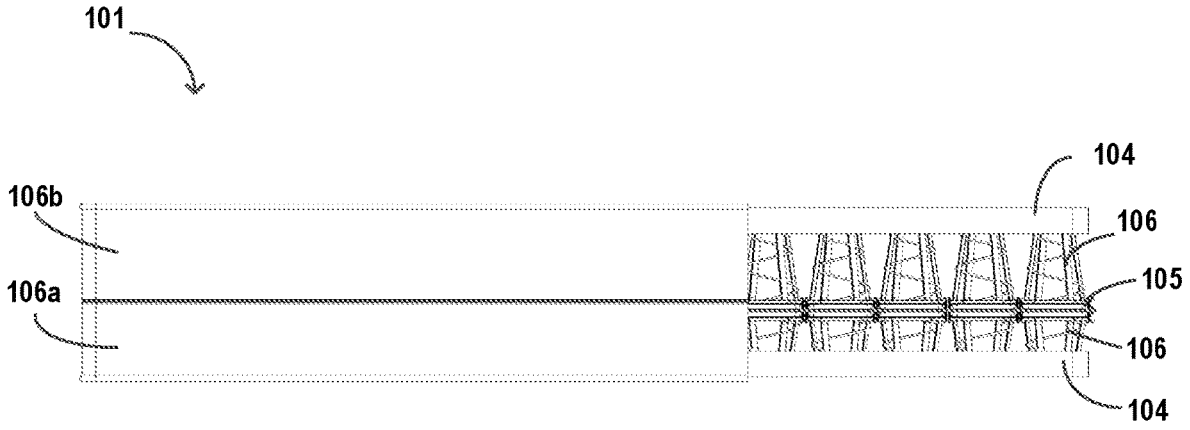

Referring now to FIGS. 8A-8B, the elastic pad body includes two elastic module layers as mentioned above, including a first elastic module layer 101*a* and a second module layer 101*b* on top of the first elastic module layer 101*a*. The first elastic module layer 101*a* and the second elastic module layer 101*b* are stacked in such manner that: small-diameter axial ends of the elastic modules of the first elastic module layer 101*a* face small-diameter axial ends of the elastic modules of the second elastic module layer 101*b*. In the present implementation, an outer contour of each elastic module 106 has a truncated cone shape. It would be appreciated that "a large-diameter axial end" and "a small-diameter axial end" are two ends of an elastic module in its axial direction, which have the largest radial dimension and the smallest dimension of the elastic module, respectively.

More preferably, the elastic pad includes two balance mesh layers 104 as mentioned above which correspond to the two elastic module layers, respectively. The dimension of each opening is consistent with the outer diameter of the small-diameter axial end of the elastic module.

In the implementation, a layer structure may be arranged between the first elastic module layer 101*a* and the second elastic module layer 101*b*, and the elastic module bottom layers 105 of the two elastic module layers are arranged on the top surface and the bottom surface of the layer structure, respectively.

Figure 9A:
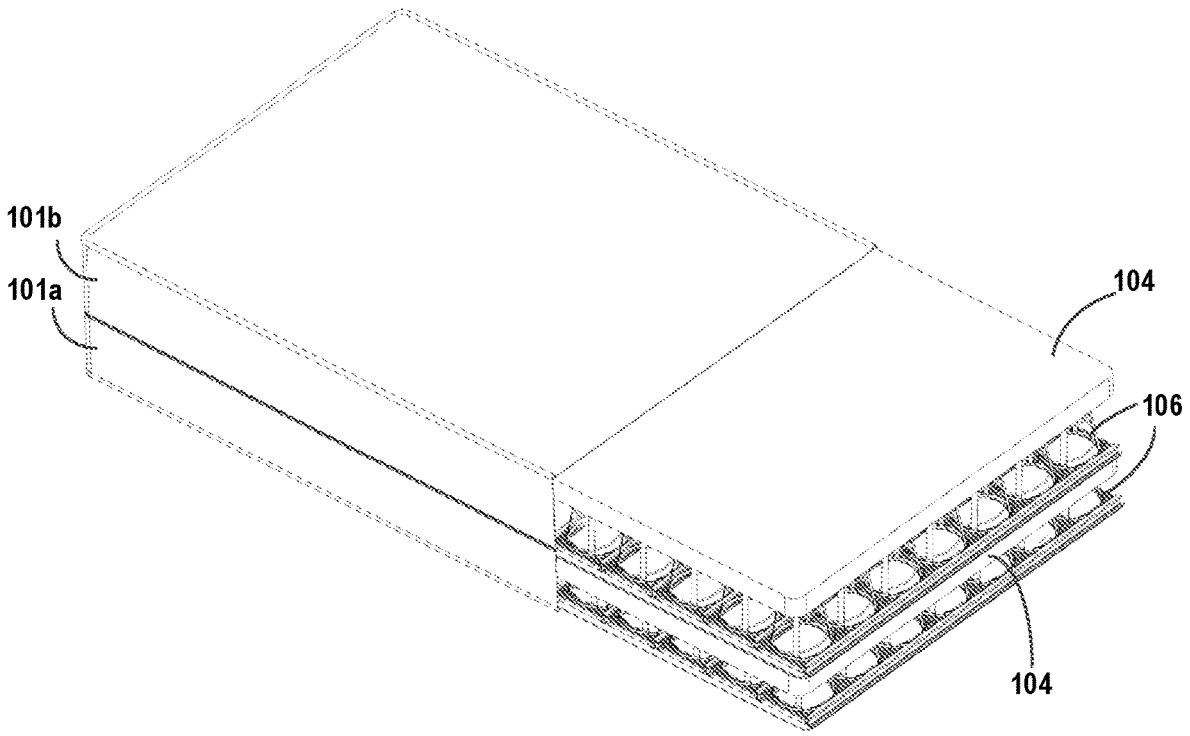
FIGS. 9A-9B are schematic diagrams of an elastic pad body according to an implementation.
Figure 9B:
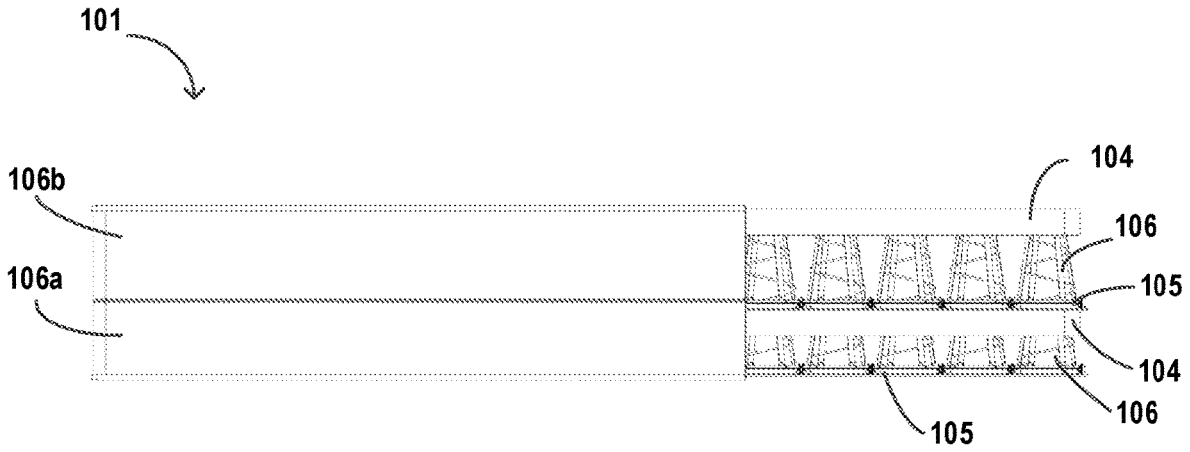

Referring to FIGS. 9A-9B, the elastic pad body includes two elastic modules layers, including a first elastic module layer 101*a* and a second elastic module layer 101*b* on top of first elastic module layer 101*a*. The first elastic module layer 101*a* and the second elastic module layer 101*b* are stacked in such manner that: small-diameter axial ends of the elastic modules of the first elastic module layer 101*a* face large-diameter axial ends of the elastic modules of the second elastic module layer 101*b*. In the present implementation, an outer contour of each elastic module 106 has a truncated cone shape. It would be appreciated that "a large-diameter axial end" and "a small-diameter axial end" are two ends of an elastic module in its axial direction, which have the largest radial dimension and the smallest dimension of the elastic module, respectively.

More preferably, the elastic pad includes two balance mesh layers 104 as mentioned above which correspond to the two elastic module layers, respectively. The dimension of each opening is consistent with the outer diameter of the small-diameter axial end of the elastic module.

In the implementations described above, each elastic module layer has a similar arrangement. Any description on the elastic module layer included here should be considered to be applicable to any one of implementations about each elastic module layer as shown in FIGS. 7A-9B.

An arrangement of an elastic module layer is taken as an example, where the elastic modules 106 may be slidably mounted in place after arranged on rail beams 108 of the elastic module layer bottom layer 105 (i.e., arranged on the bottom cover body 1013), and each of the rail beams 108 extends along the transverse direction. FIGS. 13-18 provide a specific implementation.

Figure 13:
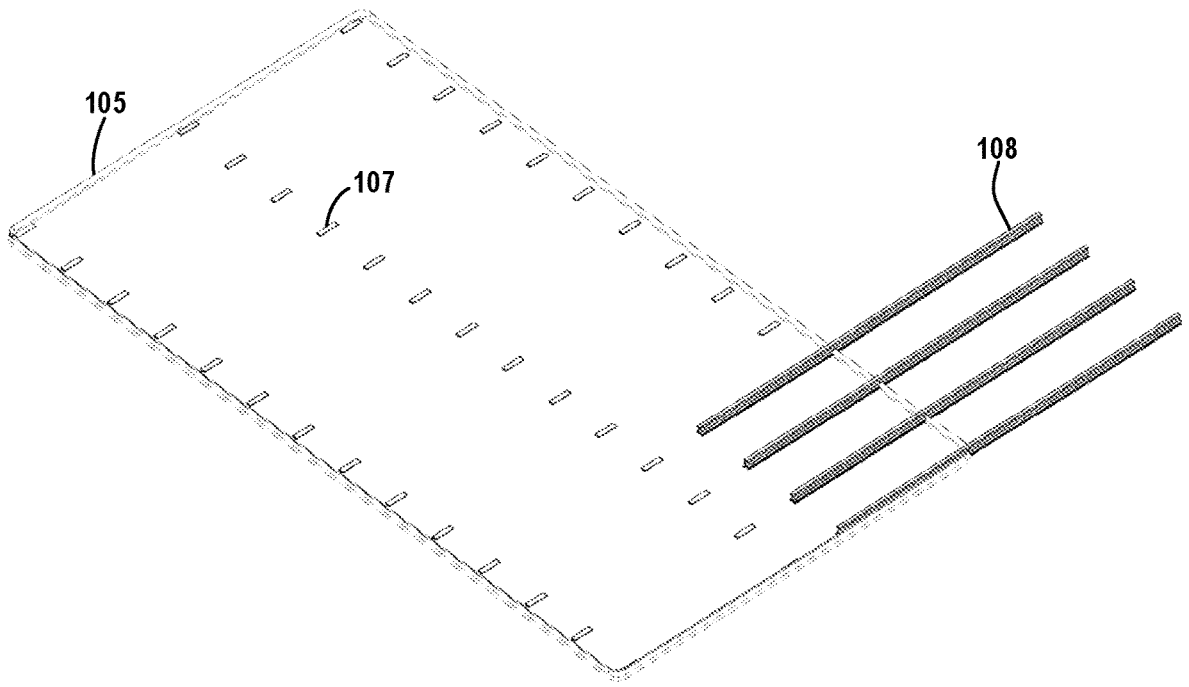
FIG. 13 is a schematic diagram of mounting rail beams on a bottom cover body according to an implementation.

Referring to FIG. 13, each rail beam 108 is removably mounted on the elastic module layer bottom layer 105 via a group of rail beam mounting parts 107, and each group of rail beam mounting parts 107 are arranged at intervals along the extending direction of the corresponding rail beam 108. Each group of rail beam mounting parts 107 include three rail beam mounting parts which are arranged at two ends and in the middle of the rail beam 108, respectively.

Figure 14A:
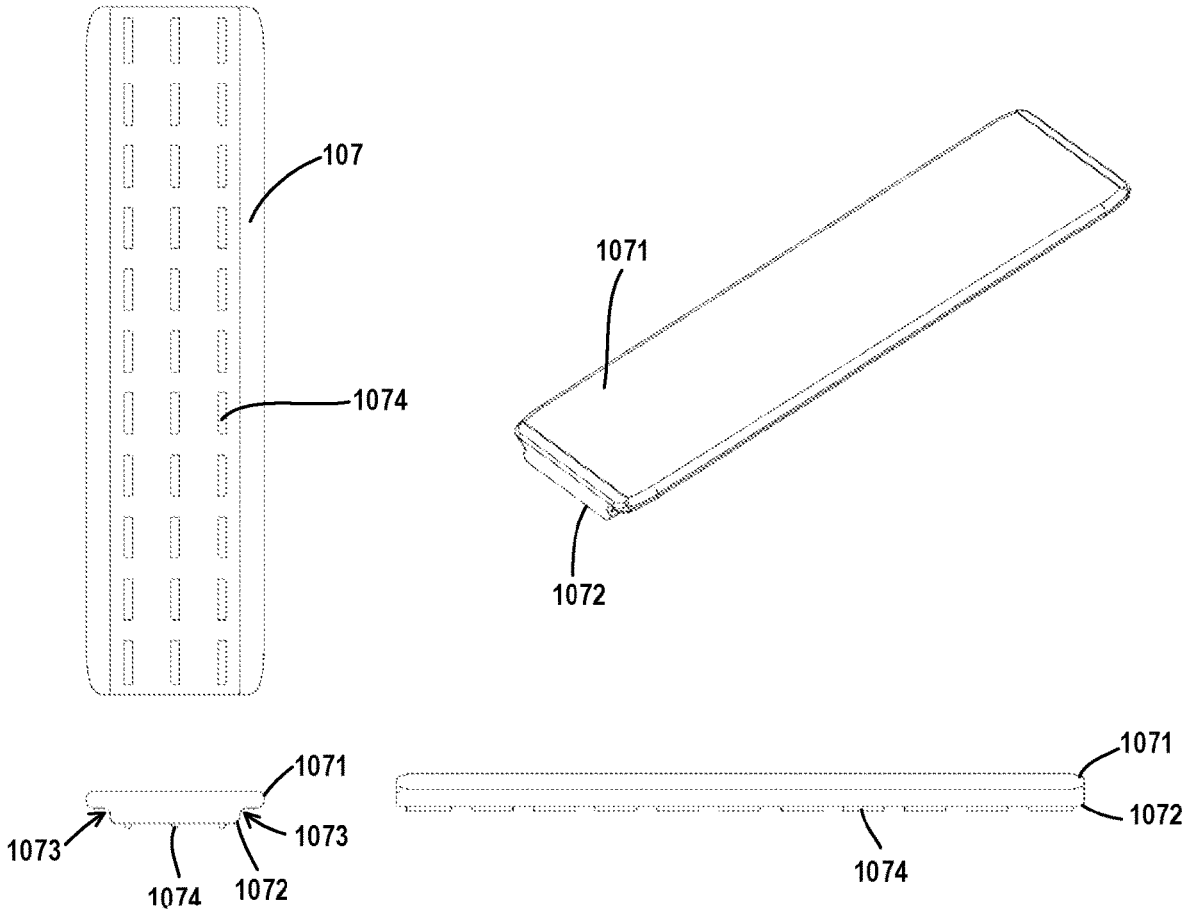
FIG. 14A is a schematic view of the rail beam mounting part in FIG. 13 from multiple perspectives.

The structure of each rail beam mounting part 107 is shown in FIG. 14A. Each rail beam mounting part 107 is provided with a mounting part protrusion located on the top thereof and protruding in a direction parallel to the direction of the elastic module layer bottom layer 105 and perpendicular to the extending direction of the rail beam 108, and a recessed portion 1073 recessed along the longitudinal direction is formed below the protrusion. In other words, each rail beam 108 includes an upper structure 1071 and a lower structure 1072, and a dimension of the upper structure 1071 in the longitudinal direction is greater than a dimension of the lower structure 1072 in the longitudinal direction so that two longitudinal ends of the upper structure 1071 form mounting part protrusions relative to the lower structure 1072. The mounting part protrusions and the recessed portion 1073 therebelow are configured to cooperate with the rail beam 108.

Continuing to refer to FIG. 14A, fixed bumps 1074 are arranged in an array on the bottom of the mounting part protrusion, which are used for ultrasonically welding the mounting part protrusion on the elastic module layer bottom layer 105.

Figure 15:
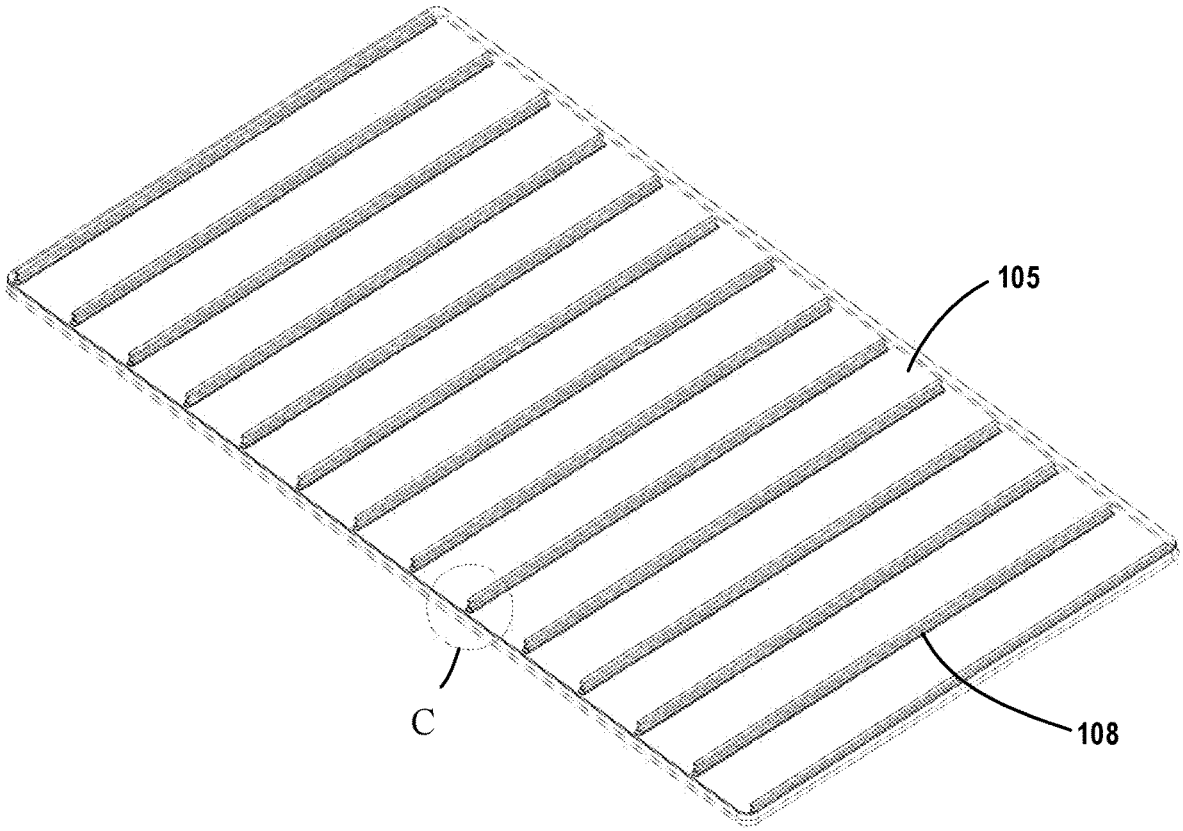
FIG. 15 is a schematic diagram after rail beams are mounted in place.
Figure 16A:
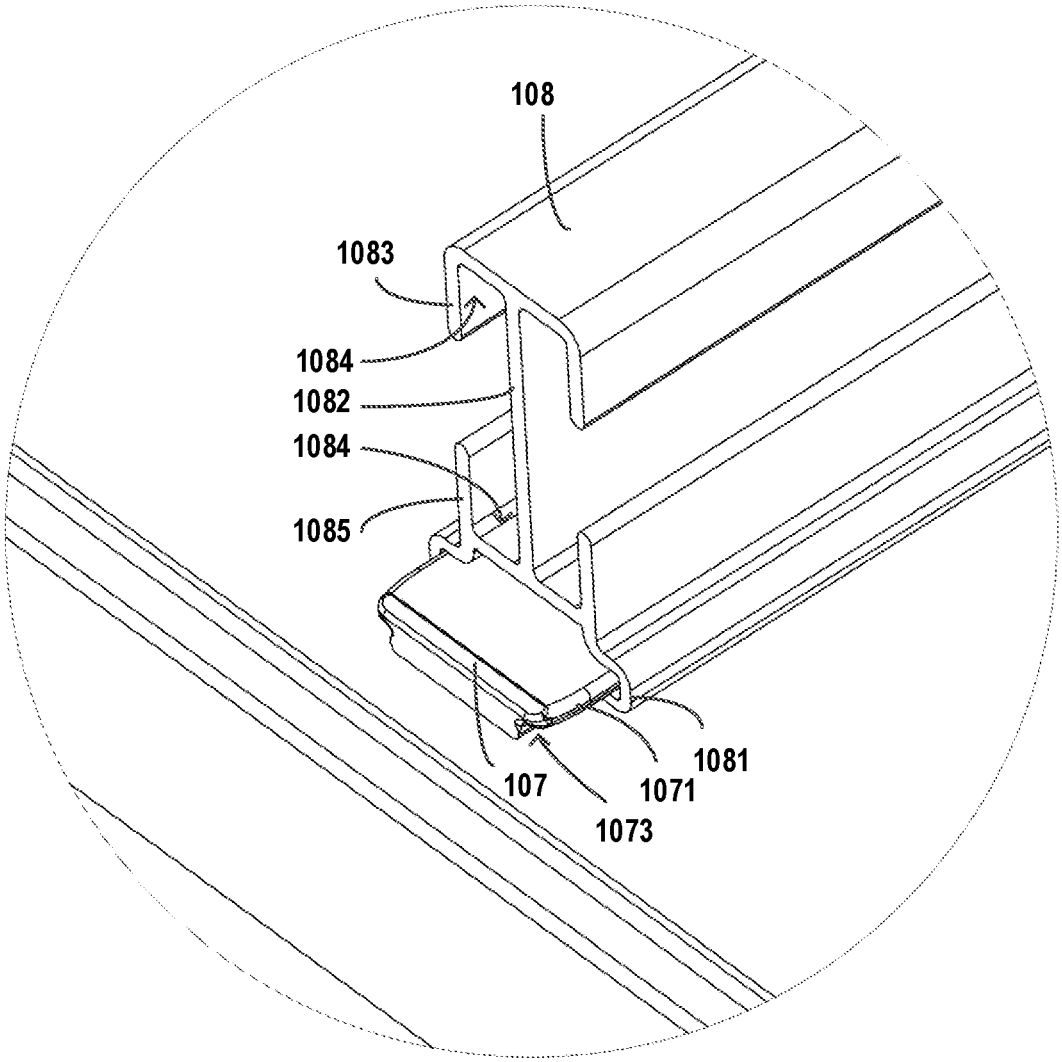
FIG. 16A is a partially enlarged view of the part C in FIG. 15.
Figure 16B:
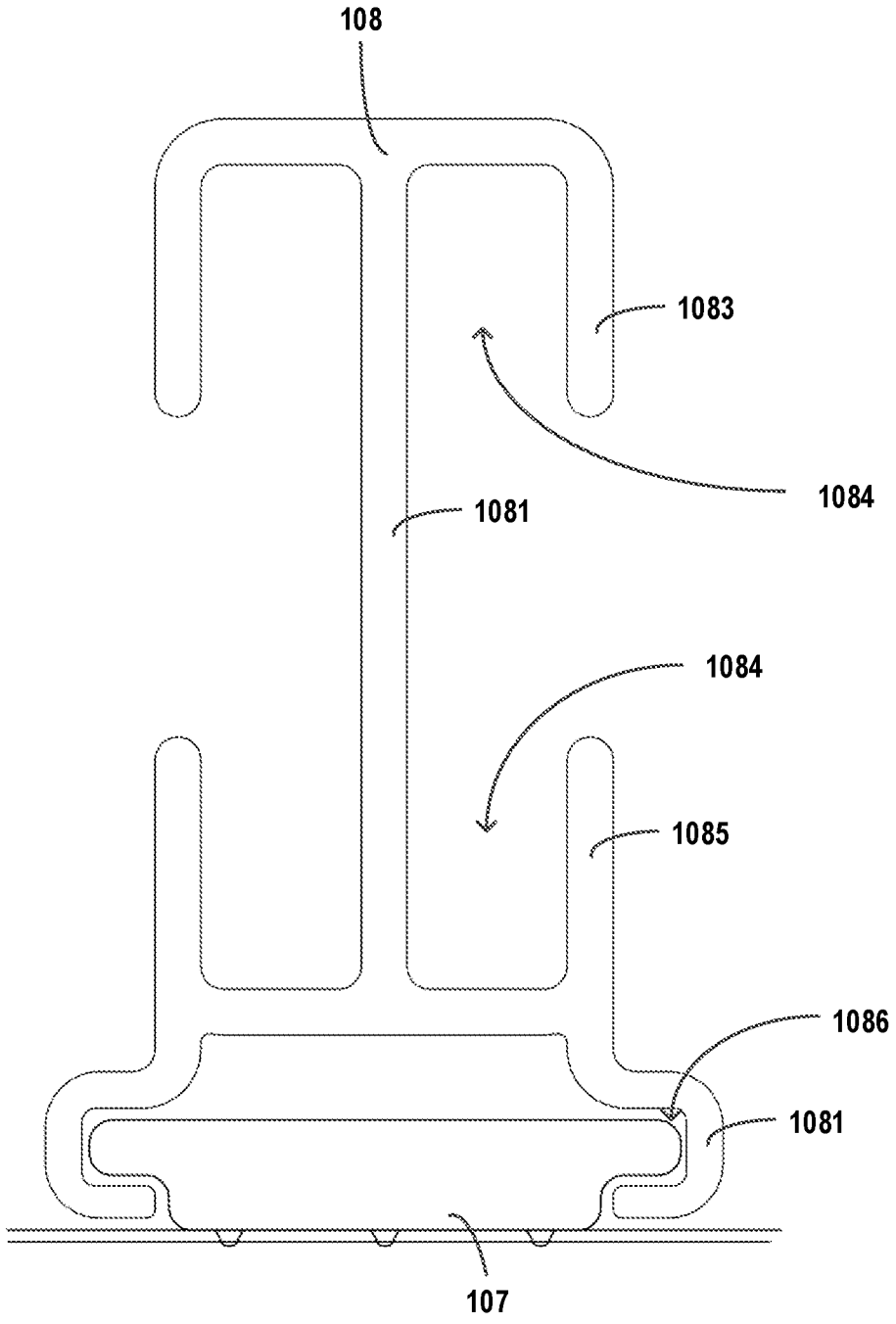
FIG. 16B is a schematic diagram of an end of the structure in FIG. 16A.

FIGS. 15-16B are schematic diagrams after the rail beam 108 is slidably mounted in place relative to the rail beam mounting parts 107 along the transverse direction. Referring to FIGS. 15-16B, a mounting receiving portion 1081 corresponding to the mounting part protrusion is provided on the bottom of the rail beam 108, and the mounting part protrusion is configured to mate with the mounting receiving portion 1081 so that the rail beam 108 can slide relative to the extending direction thereof relative to the rail beam mounting parts 107 and be mounted in place. In fact, the mounting receiving portion 1081 forms a snap hook 1086 that is snap into the recessed portion 1073 of the rail beam mounting part 107.

The main body structure of the rail beam 108 (i.e., the structure configured to cooperate with the elastic module 106) is also shown in FIGS. 16A and 16B. Each rail beam 108 includes a support wall 1082 extending from the top side to the bottom side of the rail beam 108, a top side engagement portion 1083 and a bottom side engagement portion 1085. The top side engagement portion 1083 is connected on the top side of the support wall 1082 and bends downwards and respectively towards the left and right sides of the support wall 1082, to thus form two top side receiving portions 1084 opened downwards on the top of the rail beam 108; the bottom side engagement portion 1085 is connected on the bottom side of the support wall 1082 and bent upwards and respectively towards the left and right sides of the support wall 1082, to thus form two bottom side receiving portions 1084 opened upwards on the bottom of the rail beam 108.

Figure 17:
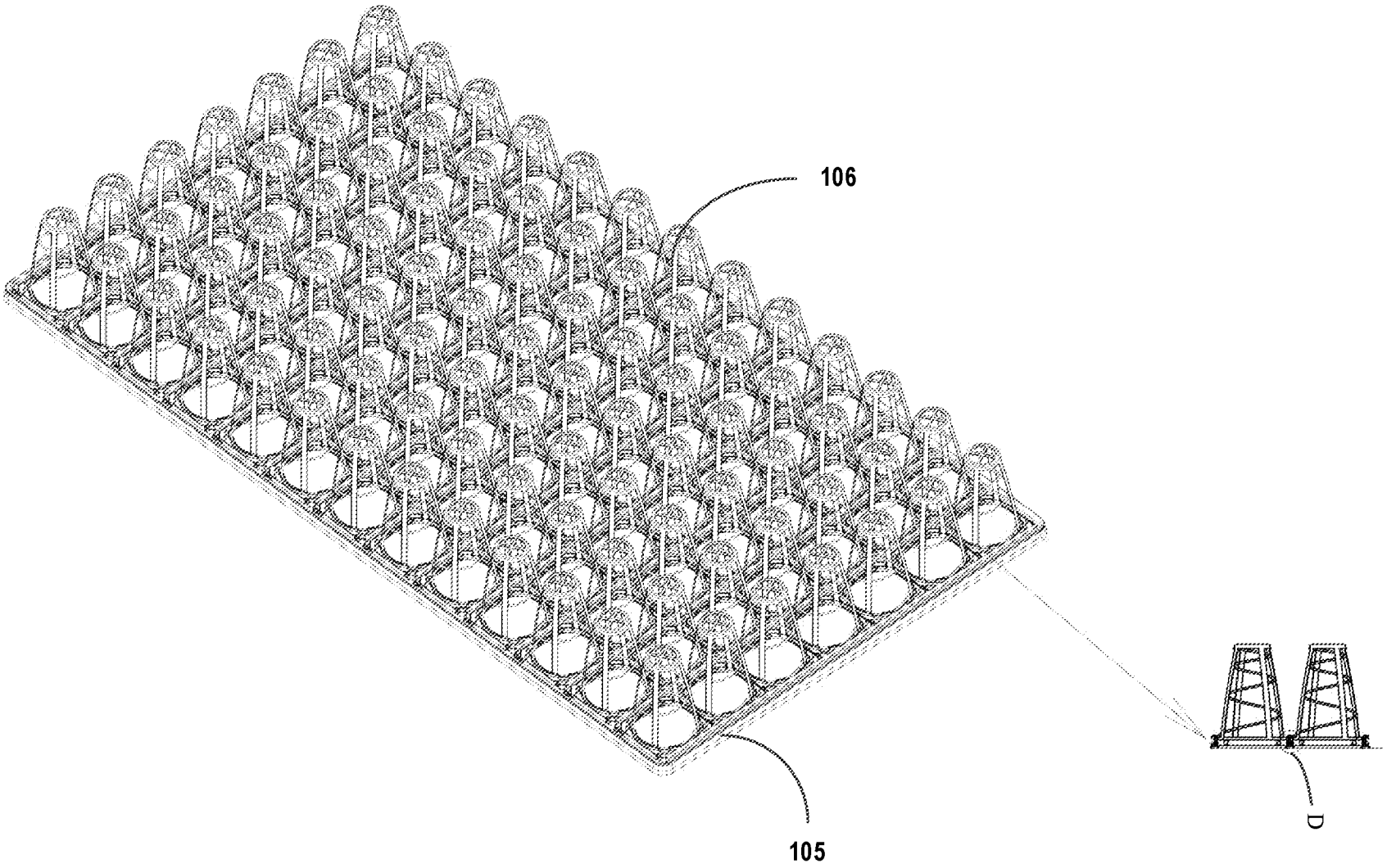
FIG. 17 is a schematic diagram of a plurality of elastic modules mounted on a bottom cover body, where a pair of adjacent elastic modules located on left and right sides of a rail beam are enlarged.
Figure 18:
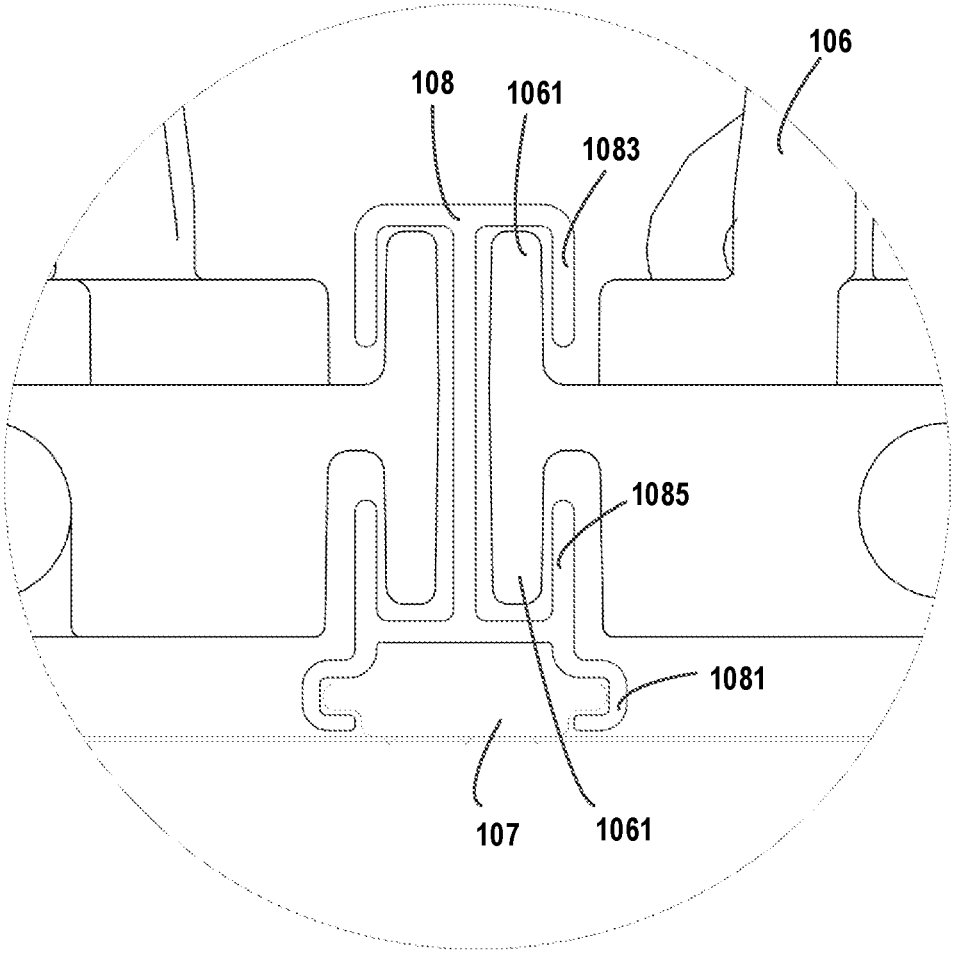
FIG. 18 is a partially enlarged view of the part D in FIG. 17.
Figure 19:
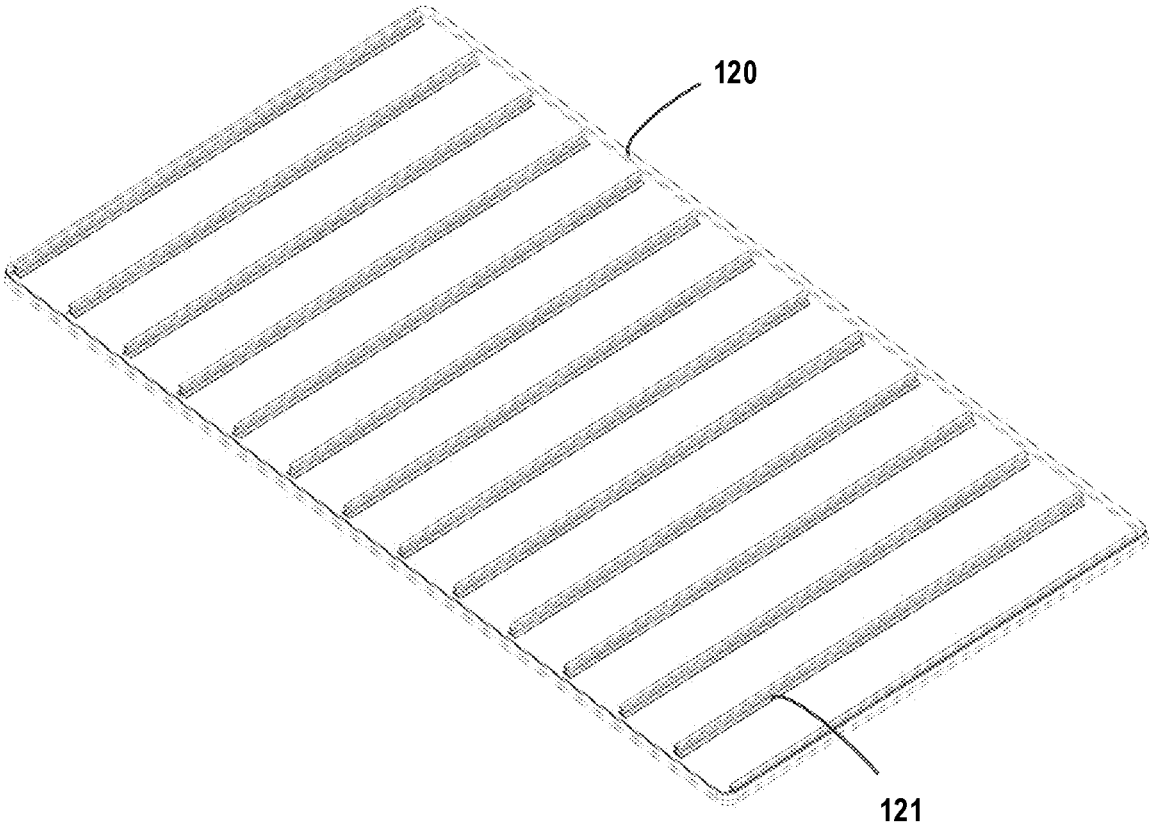
FIG. 19 is a schematic diagram when rail beams are mounted in place on a bottom cover body according to an implementation.

Correspondingly, referring to FIGS. 17 and 18, each elastic module 106 includes a conical spring and a spring bracket 106 for receiving and holding the conical spring, a mating protrusion 1061 is provided on the left and right sides of the spring bracket 106, and the mating protrusion 1061 protrudes upwards from the top surface of the bottom body of the spring bracket 106 and concurrently protrudes downwards from the bottom surface of the bottom body of the spring bracket 106 so that the mating protrusion 1061 can be received simultaneously by the receiving portion 1084 on the top side and the receiving portion 1084 on the bottom side of the rail beams 108 on the left and right sides of the elastic module 106. In other words, on the left and rights sides of each rail beam 108 are arranged structures configured to engage the elastic modules 106 on the left and right sides thereof, and the two elastic modules on both sides of the rail beam 108 are caused to be slidable independently of each other along the respective rails.

Figure 14B:
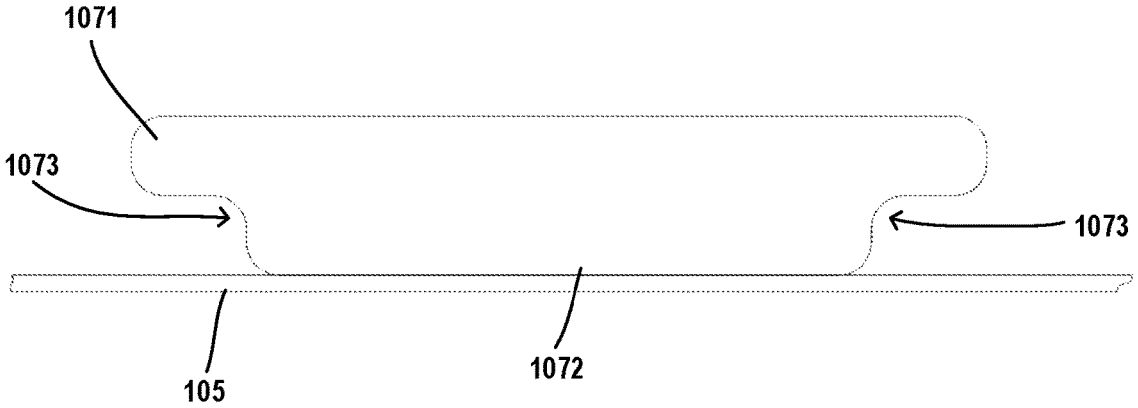
FIGS. 14B and 14C are two views showing engagement of the rail beam mounting part and the bottom cover body.
Figure 14C:
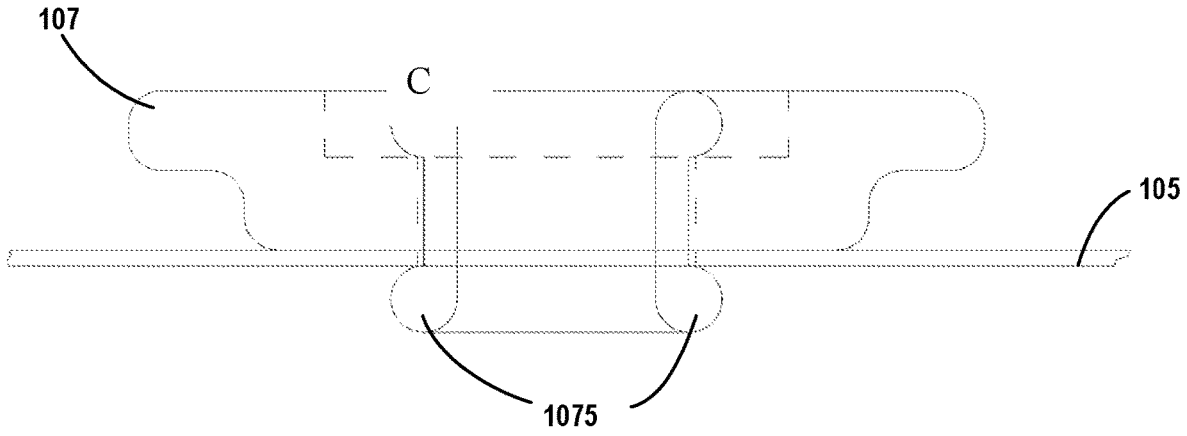

FIGS. 14B and 14C illustrate examples for replacing ultrasonic welding according to other implementations. Referring to FIG. 14B, an adhesive may be used to adhere the rail beam mounting parts to the elastic module layer bottom layer 105, and the rail beam mounting part is also provided thereon with the upper structure 1071 formed with the recessed portion 1073 and the lower structure 1072. Referring to FIG. 14C, the rail beam mounting part 107 is riveted on the elastic module layer bottom layer 105 via a rivet 1075 and provided thereon with a mounting part protrusion and a recessed portion.

Figure 20A:
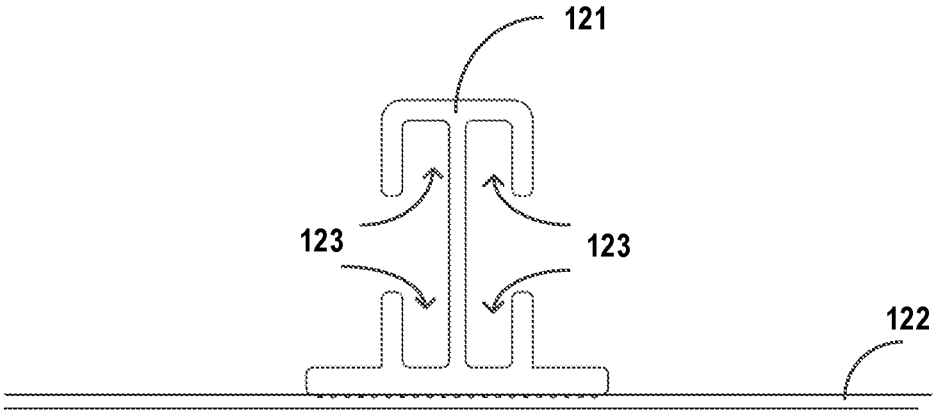
FIGS. 20A and 20B illustrate two possible states of an end of any one of the rail beams in FIG. 19.
Figure 20B:
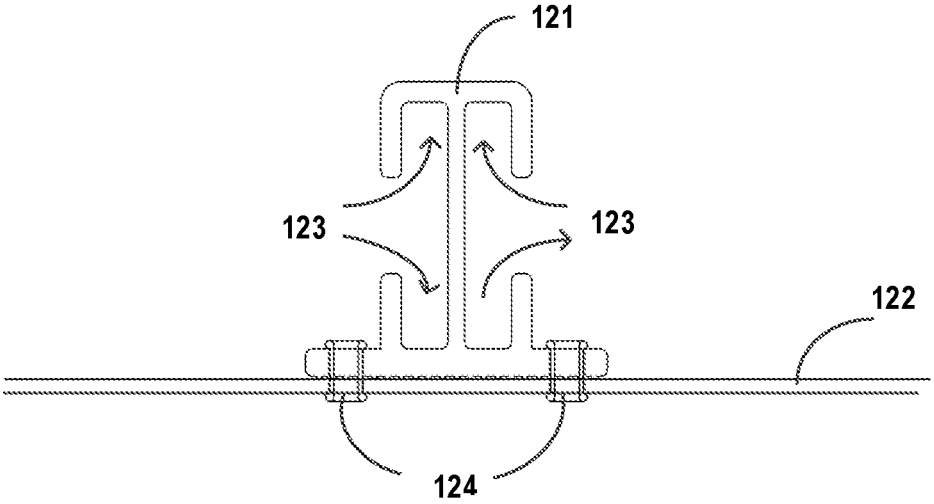
Figure 21:
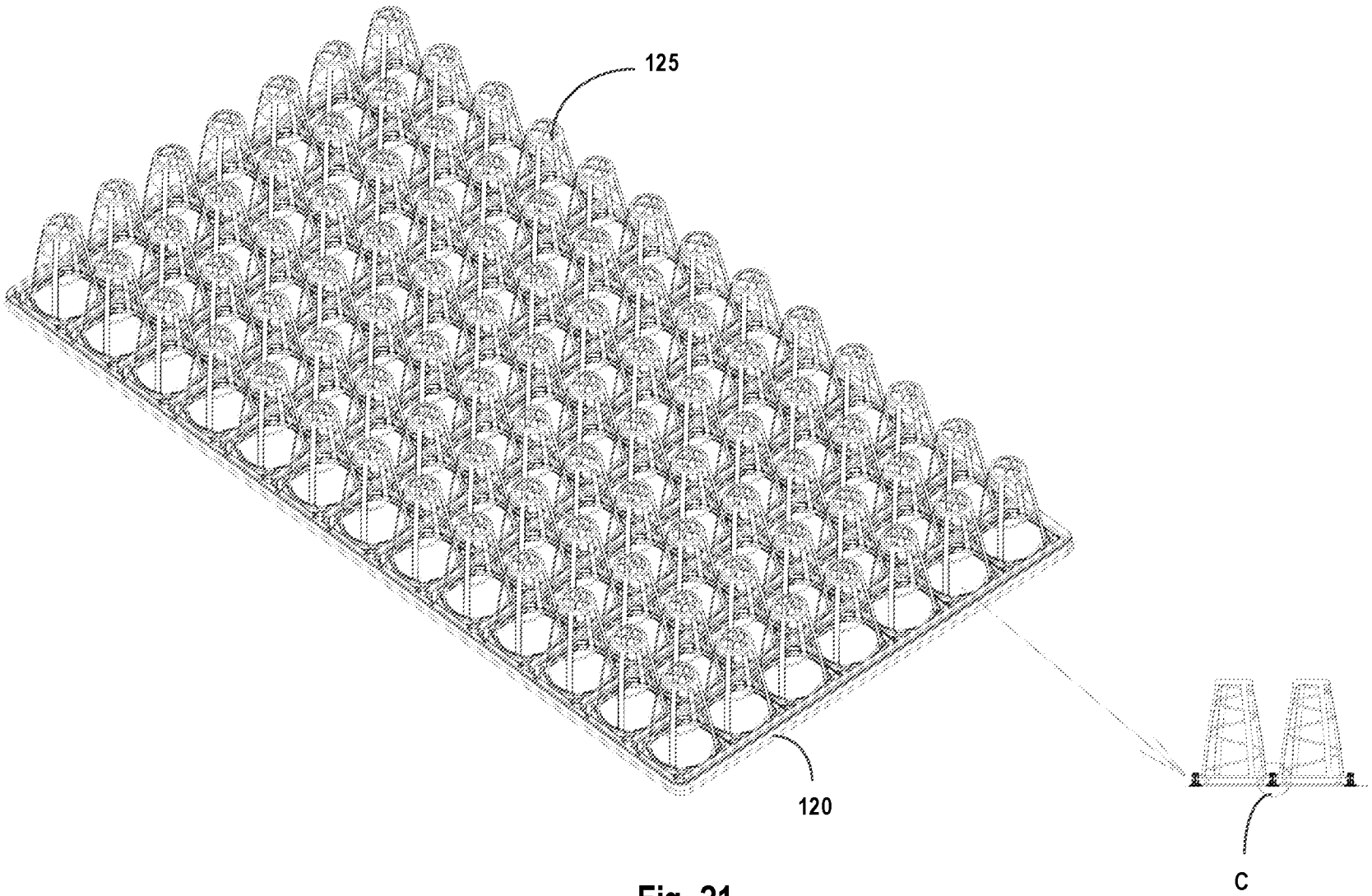
FIG. 21 is a schematic diagram of a plurality of elastic modules mounted on a bottom cover body according to the implementation, where a pair of adjacent elastic modules located on left and right sides of a rail beam are enlarged.
Figure 22:
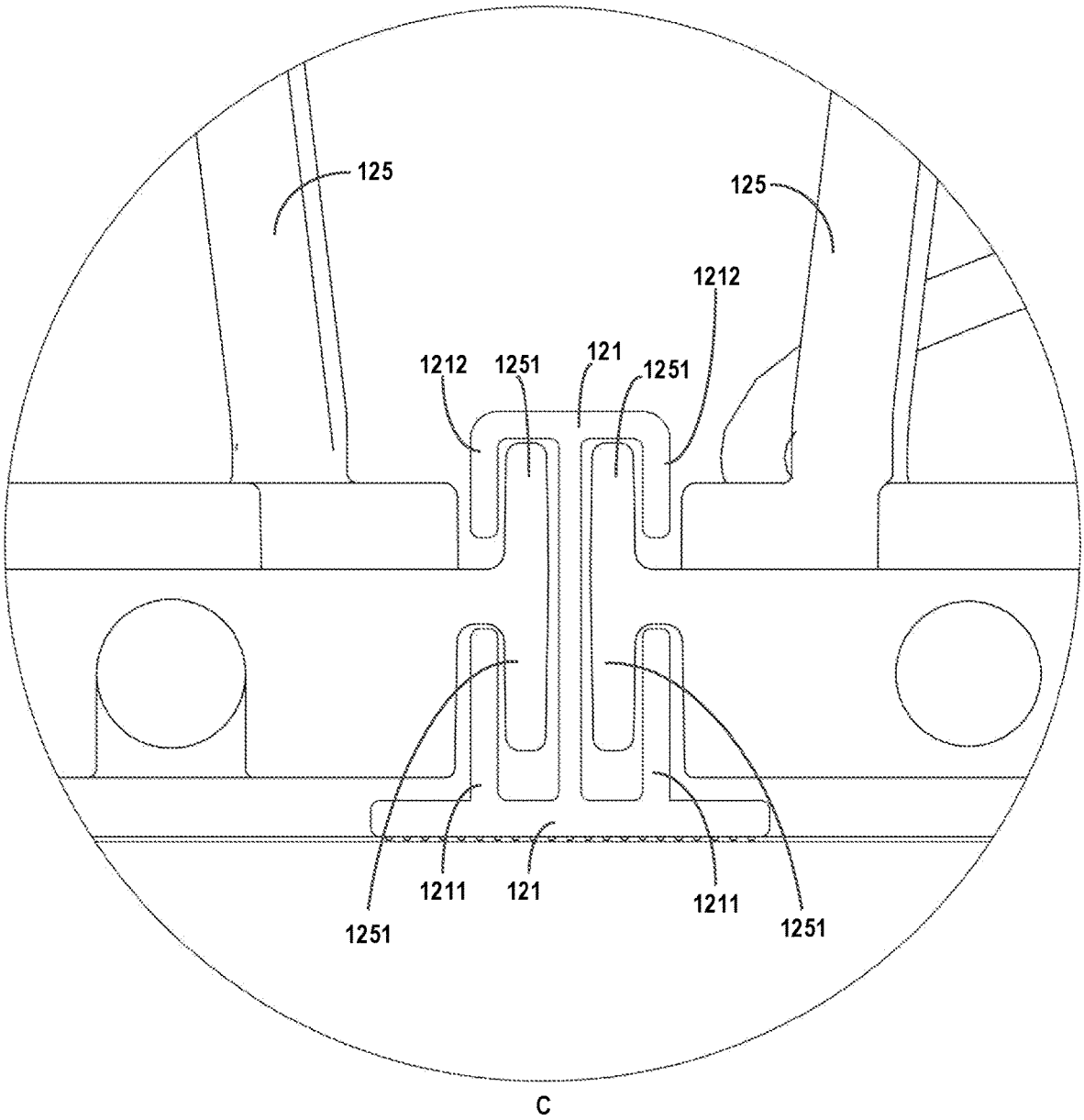
FIG. 22 is a partially enlarged view of the part C in FIG. 21.

FIGS. 20A-22 illustrate an alternative implementation. In the implementation, a mating protrusion 1251 is provided respectively on the left and right sides of the spring bracket of each elastic module 125, and the mating protrusion 1251 protrudes upwards from the top surface of the body of the spring bracket and concurrently protrudes downwards from the bottom surface of the body of the spring bracket so that the mating protrusion 1251 can be simultaneously received by receiving portions 1212 (which are formed with receiving grooves 123 as shown in FIGS. 20A and 20B) on the top and bottom sides of the rail beams 121 on the left and right sides of the elastic module. On the left and right sides of each rail beam 121 are arranged structures for engaging the elastic modules 125 located on the left and right sides thereof, and the two elastic modules on both sides of the rail beam 121 are caused to be slidable independently of each other along the respective slide rails.

However, different than those in the previous implementation, the rail beams in the implementation are directly fixed on the bottom cover body 122 by ultrasonic welding (see FIG. 20A), bonding, or riveting via a rivet 124 (see FIG. 24B). In the implementation, the arrangement of the rail beam mounting parts is omitted.

Figure 23:
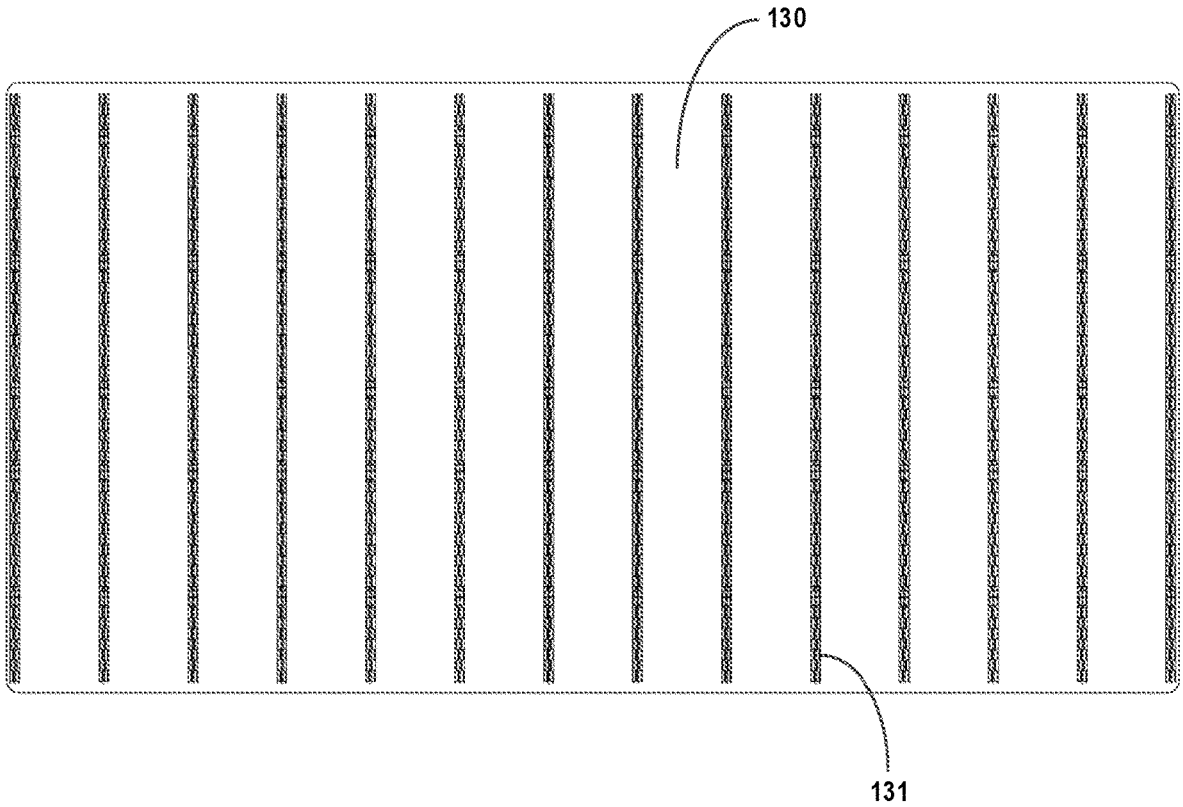
FIG. 23 is a schematic diagram when rail beams are mounted in place on a bottom cover body according to an implementation.
Figure 24:
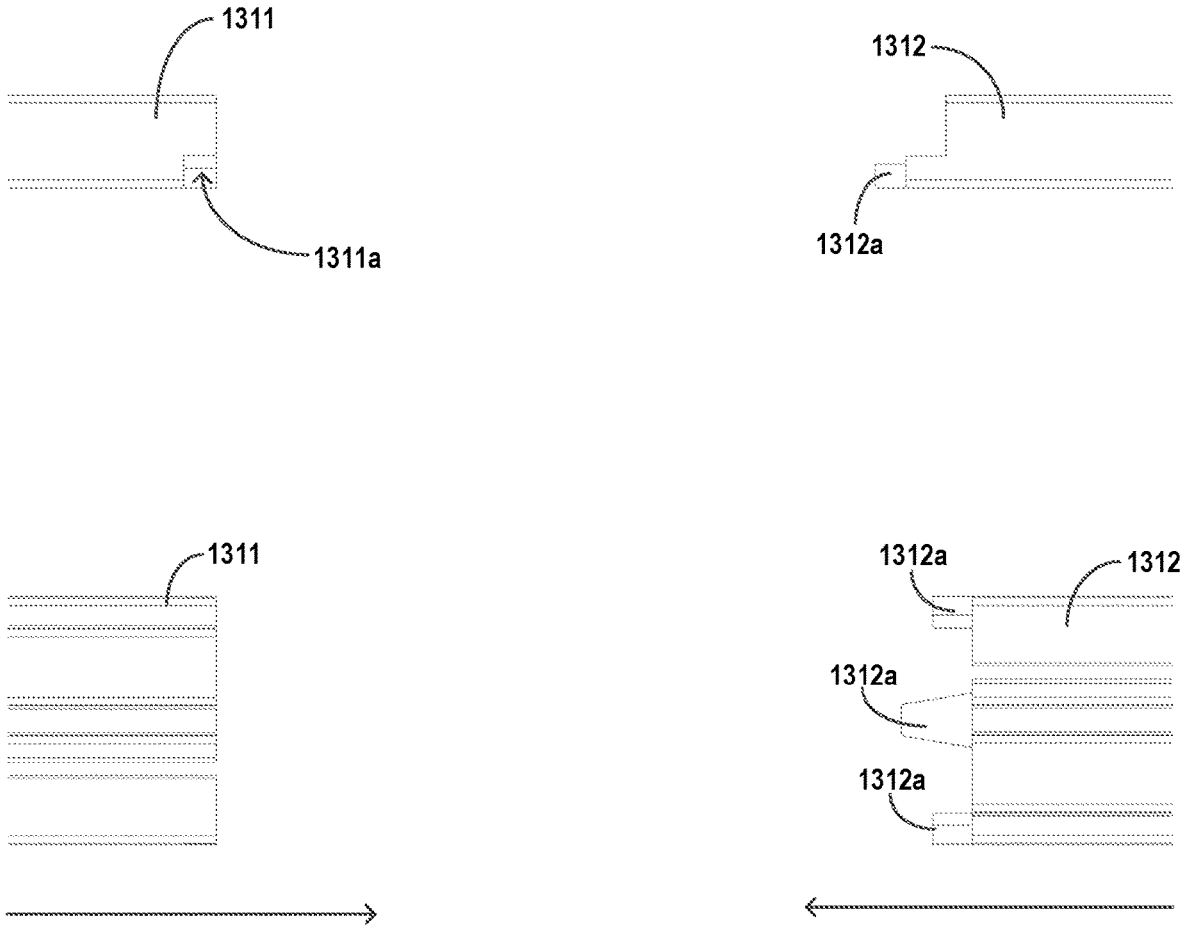
FIG. 24 is front views and top views of a pair of adjacent rail beam segments of a rail beam.
Figure 25:
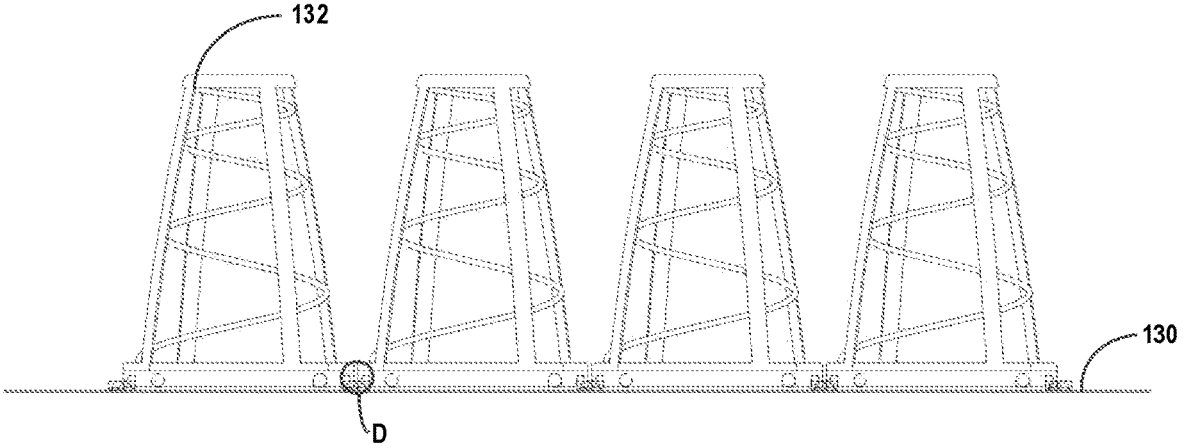
FIG. 25 is a schematic diagram when a plurality of elastic modules are mounted on the rail beam as shown in FIG. 23.

FIGS. 23-26 illustrate a further implementation. Referring now to FIG. 24, each rail beam includes a plurality of rail beam segments, where the respective rail beam segments are connected sequentially along the longitudinal direction. Each rail beam segment is provided at the front end with a forward protrusion and provided at the rear end with a recess recessed forwards, and the protrusion and the recess of the adjacent rail beam segments fit into each other to connect the adjacent rail beam segments. For example, for the adjacent rail beams as shown in FIG. 24, the protrusion 1312*a* at the front end of the first rail beam 1312 may extend into the recess 1311*a* recessed forwards at the rear end of the second rail beam 1312.

Figure 26:
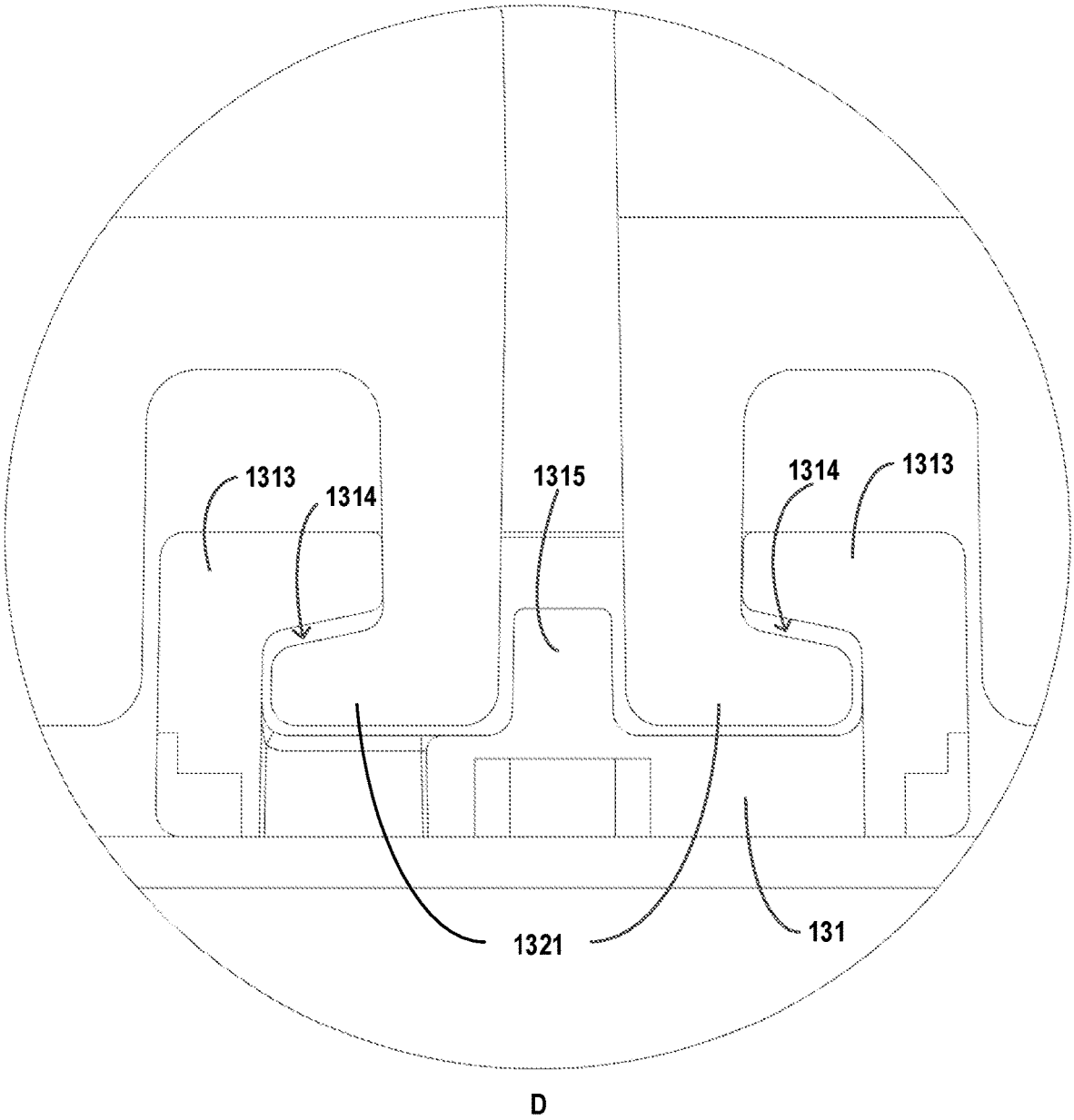
FIG. 26 is a partially enlarged view of the part D in FIG. 25.

Referring to FIG. 26, each rail beam includes: a base portion 131; a pair of connection walls extending upwards respectively on the left and rights of the base portion 131; and a pair of end walls extending towards each other from the two ends of the pair of walls. There is a gap between each pair of end walls, where the base portion 131, respectively together with a pair of connection walls and a pair of end walls, defines a pair of receiving portions 1313 opened towards each other, and the receiving portions 1313 are each formed with a receiving groove 1314. Correspondingly, on the left and right sides of the spring bracket of each elastic bracket are provided: connection legs extending downwards; and mating protrusions 1321 extending towards each other from the connection legs on the left and right sides of the spring bracket. Receiving grooves 1314 of a pair of receiving portions 1313 of each rail beam are configured to respectively engage corresponding mating protrusions 1321 of the elastic modules on the left and right sides of the rail beam. Preferably, a partition wall 1315 is arranged in the middle of the two connection walls of the base portion 131, where the height of the partition wall is less than the height of the connection wall.

As shown in FIG. 23 in detail, the connection walls on the left side of the base portion 131 are arranged at intervals in the longitudinal direction, the connection walls on the right side of the base portion 131 are arranged at intervals in the longitudinal direction, and the connection walls on the left side of the base portion 131 and the connection walls on the right side of the base portion are staggered from each other in the transverse direction.

The connection methods between the elastic module and the bottom cover body as described above can enable users to customize elastic pads according to the softness or hardness needs.

The elastic pad according to the implementation can be disassembled or stored by users. Specifically, users may first disassemble the outer cover and then remove the elastic modules 106 from the rail beams.

Further, the additional elastic pad layer 102, the top cover body 102 and the side girdle 1011 can be rolled up for storage. Still further, the rail beam or rail beam mounting part as mentioned above is formed of flexible plastic, so that the elastic module layer bottom layer 105 having a plurality of rail beams integrated thereon can be rolled up for storage along a plane perpendicular to the extending direction of the rail beams, and the soft rail beams do not penetrate through the bottom cover body after being rolled up and stored. It would be appreciated that the rail beam and the rail beam mounting part are structures each having a stable shape, but they are not necessarily very rigid. As an effect of an external force, the rail beam and the rail beam mounting part may be deformed to a certain degree.

After the outer cover 110, the additional elastic pad layer 102, the elastic modules 106 and the elastic balance mesh layer 104 of the elastic pad are separated from one another, storage may be further implemented in the following steps: stacking the additional elastic pad layer 102 and the elastic balance mesh layer 104 and rolling up and storing the same to form a first storage roll; separating the top cover body 102, the side girdle 1011 and the elastic module layer bottom layer 105 from one another (it would be appreciated that a slide fastener is respectively provided between the top cover body 102 and the side 1011, and between the side 1011 and the elastic module layer bottom layer 105), stacking them, and then rolling up and storing the same to form a second storage roll.

In addition, each elastic module 106 is configured as a truncated cone structure with an opened lower end and a hollow interior, and a plurality of elastic modules 106 are configured to allow users to remove the respective elastic modules 106 from the rail beams, and sequentially nest and store the respective elastic modules along the height direction of the elastic modules to form an elastic module storage group. In a nested stated, the lower elastic module 106 in adjacent elastic modules 106 is inserted upwards into the upper elastic module 106 via the opened lower end of the upper elastic module 106.

Moreover, users may place all of the first storage roll, the second storage roll and the elastic module storage group in a storage box. A storage box of corresponding dimensions sold or given with the elastic pads allows users to disassemble the elastic pads and store them at home.

Figure 28:
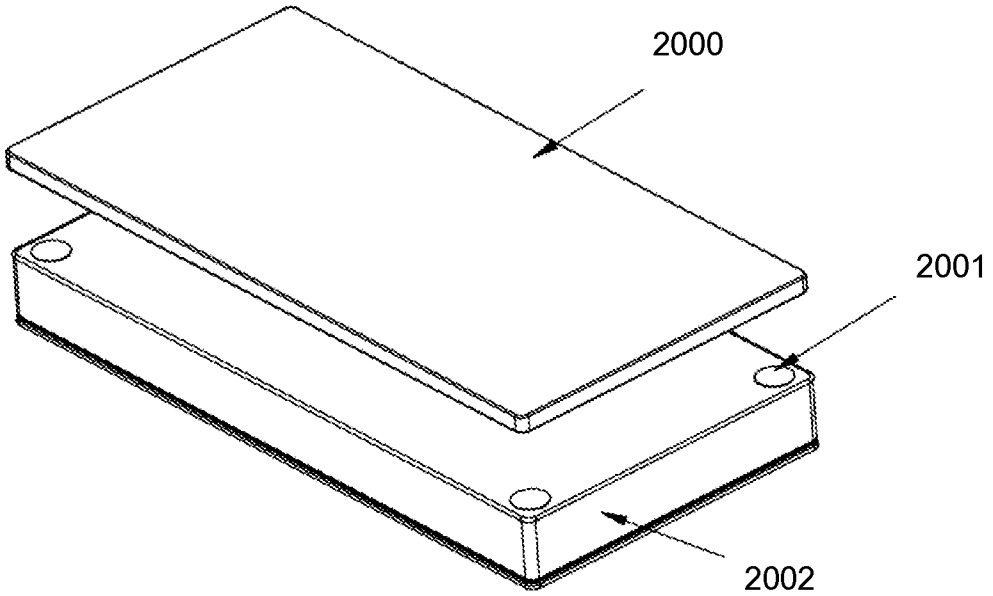
FIG. 28 is an exploded view of an elastic pad.

FIG. 28 illustrates an elastic pad layer according to a further implementation, including an elastic pad body 2002 and an additional elastic pad layer 2000. The elastic pad body 2002 and the additional elastic pad layer 2000 are attached via magic tapes. The elastic pad body 2002 according to the present implementation may be identical or similar to the elastic pad body according to other implementations. The additional elastic pad layer according to the present implementation may be identical or similar to the additional elastic pad layer according to other implementations.

The present disclosure further provides furniture comprising the elastic pad according to the above implementations. The furniture may be, for example, a sofa, a bed, a sofa bed or the like that allows users to sit or lie thereon.

The additional elastic pad layer according to the present disclosure may have a variety of structural settings available to users. In the case, each additional elastic pad layer may be manufactured and sold as an independent commodity. The present disclosure further provides an implementation of additional elastic pad layers, where independent elastic pad layers include additional elastic pad layers of the elastic pads as shown in FIGS. 1-27.

The elastic pad according to the present disclosure is a high-end elastic pad exhibiting good performance in comfort. As compared with the existing elastic pad of the same type, the elastic pad according to the present disclosure can be customized by users. As compared with the technical solution where the additional elastic pad layers are arranged within the outer cover, such arrangement can facilitate users in assembling and replacing the additional elastic pad layers.

In the preferred implementations of the present disclosure, the following convenience may be provided to users, including: 1. according to the needs in use, the users may select corresponding fittings to assemble elastic pads better meeting their own needs; and 2. if a part of the structure of the elastic pad has aged, users may purchase the corresponding fittings and continue to use the elastic pad by replacing the aged part.

The above description on multiple embodiments of the present disclosure are provided to the ordinary skilled in the related field for the purpose of illustration, without any intention to make the present disclosure exclusive or confine the same to a single embodiment disclosed here. As aforementioned, the ordinary skilled in the art would understand that multiple replacements and variations of the present disclosure are also applicable. Therefore, although some alternative embodiments are described here in detail, the ordinary skilled in the art would envision or develop easily other embodiments. The present disclosure is intended to cover all the replacements, modifications and variations of the present disclosure, and other embodiments falling into the spirits and scope described here.

I claim:

1. A customizable elastic pad comprising:

a body including: an outer cover; an elastic module layer arranged in a receiving space within the outer cover, the elastic module layer including an array of elastic modules, each elastic module having a compressed conical spring; and a balance layer having a plurality of openings, each opening sized to fit around an outer diameter of one of the elastic modules at a predetermined height, so that the elastic modules are linked to each other by the balance layer; and at least one additional elastic pad layer configured to be stacked on top of and attached to the body.

2. The elastic pad of claim 1 comprising first, second and third additional elastic pad layers, the third additional elastic pad layer harder than the second additional elastic pad layer, and the second additional elastic pad layer harder than the first additional elastic pad layer.

3. The elastic pad of claim 2 wherein:

the first additional elastic pad layer is at the top, and the third additional elastic pad layer is at the bottom; or the second additional elastic pad layer is at the top, and the third additional elastic pad layer is at the bottom; or the third additional elastic pad layer is at the top, and the first additional pad layer is at the bottom; or the first additional elastic pad layer is at the top, and the second additional pad is at the bottom; or the second additional elastic pad layer is at the top, and the first additional pad layer is at the bottom; or the third additional elastic pad layer is at the top, and the second additional pad layer at is the bottom.

4. The elastic pad of claim 2 wherein one or more of the first, second and third additional elastic pad layers comprises duck down, goose down; memory foam;

sponge; latex; and/or coir.

5. The elastic pad of claim 1 further comprising a first engagement fitting on a side of each additional elastic pad layer, and a second engagement fitting on the body configured to engage with the first engagement fittings.

6. The elastic pad of claim 5 wherein the first engagement fitting and the second fitting comprise slide fasteners or hook and loop tape.

7. The elastic pad of claim 6 wherein each rail beam comprises a plurality of rail beam segments connected sequentially.

8. The elastic pad of claim 7 wherein each rail beam segment has a front protrusion protruding forwards and a rear recess configured for connecting adjacent rail beam segments.

9. The elastic pad of claim 7 wherein each elastic module has a truncated cone shape, the elastic pad including a first elastic module layer and a second elastic module layer stacked on top of the first elastic module layer wherein: smaller-diameter ends of elastic modules of the first elastic module layer are facing small-diameter ends of elastic modules of the second elastic module layer; or smaller-diameter axial ends of elastic modules of the first elastic module layer are facing larger-diameter axial ends of elastic modules of the second elastic module layer.

10. The elastic pad of claim 1 further comprising first and second additional elastic pad layers, a first engagement fitting on a side of the first additional elastic pad layer vertically aligned with a first engagement fitting on a side of the second additional elastic pad layer, and a second engagement fitting on the body configured to engage with the first engagement fitting on each of the first and second additional elastic pad layers.

11. The elastic pad of claim 10 wherein each first engagement fitting comprises a buckle, and the second engagement fitting comprises an upper fastener and a lower fastener on a webbing, wherein the webbing can extend through the buckle and the upper fastener can engage with the lower fastener.

12. The elastic pad of claim 1 wherein each elastic module comprises a spring bracket for receiving and holding the conical spring, the elastic module layer further comprising a plurality of rail beams arranged on a bottom layer, the elastic modules configured to be mounted on and to slide along the rail beams.

13. The elastic pad of claim 12 wherein the elastic modules can slide independently of each other along the rail beams.

14. The elastic pad of claim 13 wherein each rail beam comprises:

a vertical support wall extending from a top to the bottom of the rail beam;

a down-facing top engagement portion;

an up-facing bottom engagement portion;

the spring bracket of each elastic module having left and right side protrusions engageable with the top engagement portions and the bottom engagement portions of each rail beam.

15. The elastic pad of claim 13 wherein each beam comprises:

a pair of connection walls extending up from a base portion;

a pair of end walls extending towards each other from the pair of connection walls, with a gap between the pair of end walls;

the base portion, connection walls and end walls forming a pair of receiving portions facing each other;

wherein the spring bracket of each of elastic module has downwardly extending connection legs and protrusions on bottom ends of the connection legs extending away from each other, the protrusions configured to engage a pair of the receiving portions of each of the rail beams.

16. The elastic pad of claim 15 wherein a partition wall is arranged in a middle of the two connection walls of the base portion, the partition wall having a height less than the connection walls.

17. The elastic pad of claim 15 wherein the connection walls on left and right sides of the base portion are arranged at longitudinal intervals and are staggered from each other.

18. The elastic pad of claim 17 further including a lateral protrusion at the top of each rail beam mounting part and a recess below the lateral protrusion, the lateral protrusion configured to mate with the rail beam so that the rail beam can slide relative to the rail beam mounting part.

19. The elastic pad of claim 13 wherein a plurality of groups of rail beam mounting parts are arranged removably on a body bottom cover, and each group of rail beam mounting parts are arranged at longitudinal intervals.

20. The elastic pad of claim 1 wherein the outer cover comprises a top cover body, a bottom cover body and a side girdle between the bottom cover body and the top cover body and extending entirely along a circumferential direction, and the side girdle and the top cover body, and the side girdle and the bottom cover body are connected removably, respectively, to allow selection and replacement of the elastic module layer and the balance layer.

21. A bed, a sofa or a sofa bed, comprising one or more elastic pad of claim 20.

* * * * *